US006229508B1

(12) United States Patent
Kane

(10) Patent No.: US 6,229,508 B1
(45) Date of Patent: May 8, 2001

(54) ACTIVE MATRIX LIGHT EMITTING DIODE PIXEL STRUCTURE AND CONCOMITANT METHOD

(75) Inventor: Michael Gillis Kane, Skillman, NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/161,862

(22) Filed: Sep. 28, 1998

Related U.S. Application Data

(60) Provisional application No. 60/060,387, filed on Sep. 29, 1997, and provisional application No. 60/060,386, filed on Sep. 29, 1997.

(51) Int. Cl.[7] ..... G09G 3/36

(52) U.S. Cl. ..... 345/82; 345/205; 345/206

(58) Field of Search ..... 345/82, 83, 44, 345/46, 78, 204, 91, 92, 205, 206

(56) References Cited

U.S. PATENT DOCUMENTS

| | | | | |
|---|---|---|---|---|
| 5,218,464 | * | 6/1993 | Hiroki et al. | 359/59 |
| 5,723,950 | * | 3/1998 | Wei et al. | 315/169.3 |
| 5,903,246 | * | 5/1999 | Dingwall | 345/82 |
| 5,952,789 | * | 9/1999 | Steward et al. | 315/169.4 |
| 5,959,599 | * | 9/1999 | Hirakata | 345/92 |

FOREIGN PATENT DOCUMENTS

| | | | |
|---|---|---|---|
| 0 653 741 A1 | 5/1995 | (EP) | 3/30 |
| 0 731 444 A1 | 9/1996 | (EP) | 3/36 |
| 0 755 042 A1 | 1/1997 | (EP) | 3/22 |
| 0 778 556 A2 | 6/1997 | (EP) | 3/30 |
| 2 106 299 | 4/1983 | (GB) | 3/12 |

OTHER PUBLICATIONS

European Patent Office Search Report dated Feb. 1, 1999.

R.M.A. Dawson et al., "Design of an Improved Pixel for a Polysilicon Active–Matrix Organic LED Display," Technical Digest for the 1998 Symposium of the Society for Information Display, pp. 11–14.

C. C. Wu et al., "Integration on Organic LEDs and Amorphous Si TFTs onto Flexible and Lightweight Metal Foil substrates," IEEE Electron Device Letters, vol. 18, No. 12, Dec. 1997.

C. C. Wu et al., "Integration on Organic LEDs and Amorphous Si TFTs onto Unbreakable Metal Foil Substrates," 1996 Int. Electron Devices Meeting Tech. Digest, pp. 957–959.

T. Wakimoto, "Organic LED Dot Matrix Display," Technical Digest for the 1996 Symposium of the Society for Information Display, pp. 849–852.

* cited by examiner

*Primary Examiner*—Richard Hjerpe
*Assistant Examiner*—Kevin M. Nguyen
(74) *Attorney, Agent, or Firm*—William J. Burke; Abhik A. Huq

(57) ABSTRACT

LED pixel structures and methods that improve brightness uniformity by reducing current nonuniformities in a light-emitting diode of the pixel structures are disclosed.

9 Claims, 14 Drawing Sheets

ACTIVE MATRIX LIGHT EMITTING DIODE PIXEL STRUCTURE AND CONCOMITANT METHOD

This application claims the benefit of U.S. Provisional Application No. 60/060,386 filed Sep. 29, 1997, and U.S. Provisional Application No. 60/060,387 filed Sep. 29, 1997, which are herein incorporated by reference.

The invention relates to an active matrix light emitting diode pixel structure. More particularly, the invention relates to a pixel structure that improves brightness uniformity by reducing current nonuniformities in a light-emitting diode of the pixel structure and method of operating said active matrix light emitting diode pixel structure.

BACKGROUND OF THE DISCLOSURE

Matrix displays are well known in the art, where pixels are illuminated using matrix addressing as illustrated in FIG. 1. A typical display 100 comprises a plurality of picture or display elements (pixels) 160 that are arranged in rows and columns. The display incorporates a column data generator 110 and a row select generator 120. In operation, each row is sequentially activated via row line 130, where the corresponding pixels are activated using the corresponding column lines 140. In a passive matrix display, each row of pixels is illuminated sequentially one by one, whereas in an active matrix display, each row of pixels is first loaded with data sequentially. Namely, each row in the passive matrix display is only "active" for a fraction of the total frame time, whereas each row in the active matrix display can be set to be "active" for the entire total frame time.

With the proliferation in the use of portable displays, e.g., in a laptop computer, various display technologies have been employed, e.g., liquid crystal display (LCD) and light-emitting diode (LED) display. Generally, an important criticality in portable displays is the ability to conserve power, thereby extending the "on time" of a portable system that employs such display.

In a LCD, a backlight is on for the entire duration in which the display is in use. Namely, all pixels in a LCD are illuminated, where a "dark" pixel is achieved by causing a polarized layer to block the illumination through that pixel. In contrast, a LED display only illuminates those pixels that are activated, thereby conserving power by not having to illuminate dark pixels.

FIG. 2 illustrates a prior art active matrix LED pixel structure 200 having two NMOS transistors N1 and N2. In such pixel structure, the data (a voltage) is initially stored in the capacitor C by activating transistor N1 and then activating "drive transistor" N2 to illuminate the LED. Although a display that employs the pixel structure 200 can reduce power consumption, such pixel structure exhibits nonuniformity in intensity level arising from several sources.

First, it has been observed that the brightness of the LED is proportional to the current passing through the LED. With use, the threshold voltage of the "drive transistor" N2 may drift, thereby causing a change in the current passing through the LED. This varying current contributes to the nonuniformity in the intensity of the display.

Second, another contribution to the nonuniformity in intensity of the display can be found in the manufacturing of the "drive transistor" N2. In some cases, the "drive transistor" N2 is manufactured from a material that is difficult to ensure initial threshold voltage uniformity of the transistors such that variations exist from pixel to pixel.

Third, LED electrical parameters may also exhibit nonuniformity. For example, it is expected that OLED (organic light-emitting diode) turn-on voltages may increase under bias-temperature stress conditions.

Therefore, a need exists in the art for a pixel structure and concomitant method that reduces current nonuniformities due to threshold voltage variations in a "drive transistor" of the pixel structure.

SUMMARY OF THE INVENTION

The present invention incorporates a LED (or an OLED) pixel structure and method that improve brightness uniformity by reducing current nonuniformities in a light-emitting diode of the pixel structure. In one embodiment, a pixel structure having five transistors is disclosed. In an alternate embodiment, a pixel structure having three transistors and a diode is disclosed. In yet another alternate embodiment, a different pixel structure having five transistors is disclosed. In yet another alternate embodiment, an additional line is provided to extend the autozeroing voltage range. Finally, an external measuring module and various external measuring methods are disclosed to measure pixel parameters that are then used to adjust input pixel data.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 3:
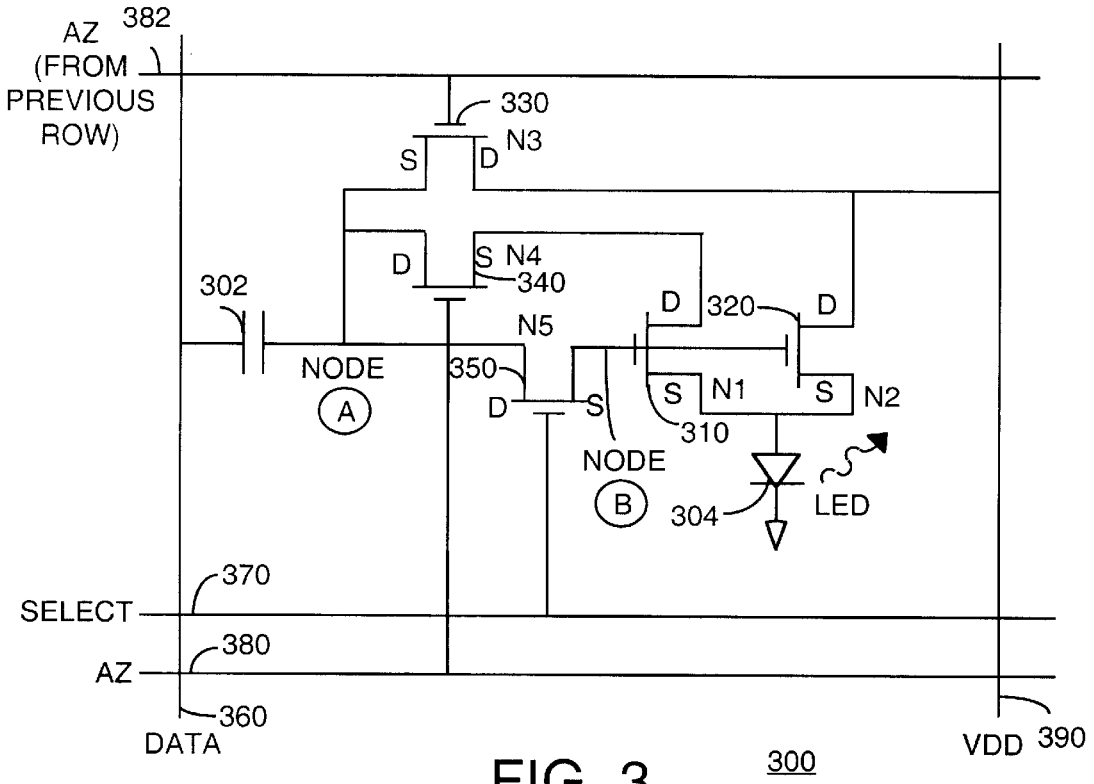
FIG. 3 depicts a schematic diagram of an active matrix LED pixel structure of the present invention.

FIG. 3 depicts a schematic diagram of an active matrix LED pixel structure 300 of the present invention. In the preferred embodiment, the active matrix LED pixel structure is implemented using thin film transistors (TFTs), e.g., transistors manufactured using poly-silicon or amorphous silicon. Similarly, in the preferred embodiment, the active matrix LED pixel structure incorporates an organic light-emitting diode (OLED). Although the present pixel structure is implemented using thin film transistors and an organic light-emitting diode, it should be understood that the present invention can be implemented using other types of transistors and light emitting diodes.

The present pixel structure 300 provides a uniform current drive in the presence of a large transistor threshold voltage ($V_t$) nonuniformity and OLED turn-on voltage nonuniformity. In other words, it is desirable to maintain a uniform current through the OLEDs, thereby ensuring uniformity in the intensity of the display.

Referring to FIG. 3, pixel structure 300 comprises five NMOS transistors N1 (310), N2 (320), N3 (330), N4 (340) and N5 (350), a capacitor 302 and a LED (OLED) (light element) 304 (light element). A Select line 370 is coupled to the gate of transistor 350. A Data line 360 is coupled to one terminal of the capacitor 302. An Autozero line 380 is coupled to the gate of transistor 340. A VDD line 390 is coupled to the drain of transistors 320 and 330. An Autozero line 382 from a previous row in the pixel array is coupled to the gate of transistor 330.

It should be noted that Autozero line 382 from a previous row can be implemented as a second Select line. Namely, the timing of the present pixel is such that the Autozero line 382 from a previous row can be exploited without the need of a second Select line, thereby reducing complexity and cost of the present pixel.

One terminal of the capacitor 302 is coupled (at node A) to the source of transistor 330 and to the drain of transistors 340 and 350. The source of transistor 350 is coupled (at node B) to the gate of transistors 310 and 320. The drain of transistor 310 is coupled to the source of transistor 340. Finally, the source of transistors 310 and 320 are coupled to one terminal of the LED 304.

As discussed above, driving an organic LED display is challenging in light of the various nonuniformities. The present invention is an architecture for an organic LED display that addresses these criticalities. Namely, each LED pixel is driven in a manner that is insensitive to variations in the LED turn-on voltage, as well as to variations in the TFT threshold voltages. Namely, the present pixel is able to determine an offset voltage parameter using an autozeroing method that is used to account for these variations in the LED turn-on voltage, and the TFT threshold voltages.

Furthermore, data is provided to each pixel as a data voltage in a manner that is very similar to that used in conventional active-matrix liquid crystal displays. As a result, the present display architecture can be employed with conventional column and row scanners, either external or integrated on the display plate.

Figure 4:
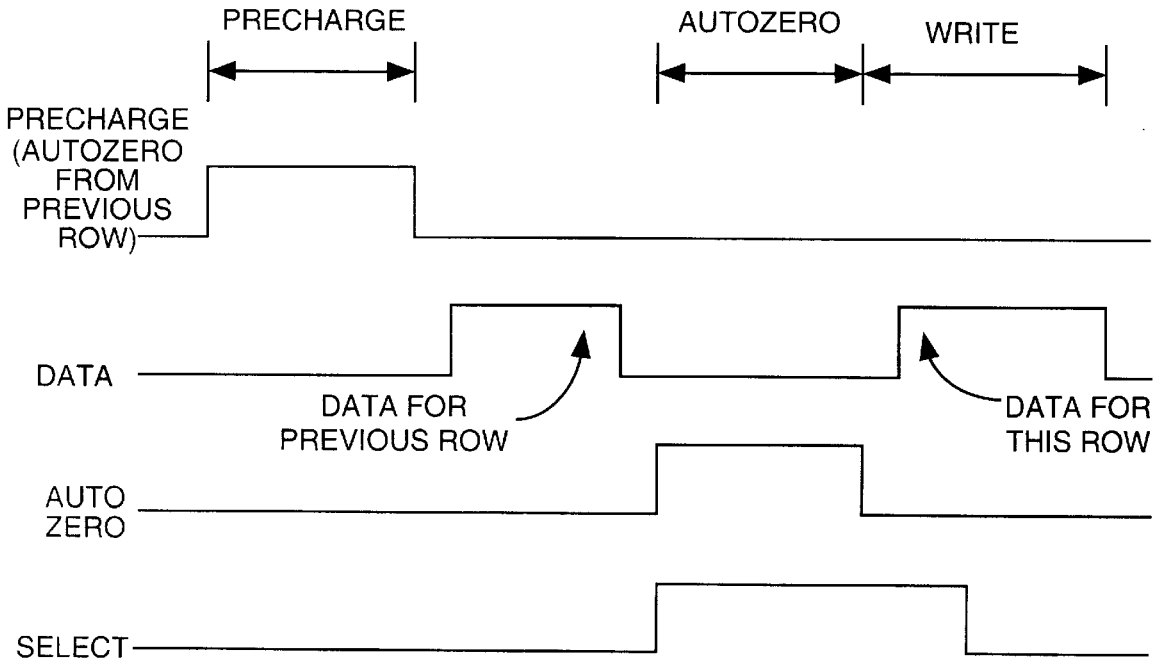
FIG. 4 depicts a timing diagram for active matrix LED pixel structure of FIG. 3.

The present pixel uses five (5) TFTs and one capacitor, and the LED. It should be noted that TFTs are connected to the anode of the LED, and not the cathode, which is required by the fact that ITO is the hole emitter in conventional organic LED. Thus, the LED is coupled to the source of a TFT, and not the drain. Each display column has 2 row lines (the auto-zero line and the select line), and 1½ column lines (the data line and the +Vdd line, which is shared by neighboring columns). The waveforms on each line are also shown in FIG. 4. The operation of the pixel 300 is described below in three phases or stages.

The first phase is a precharge phase. A positive pulse on the auto-zero (AZ) line of the previous row 382 turns "on" transistor 330 and precharges node A of the pixel up to Vdd, e.g., +10 volts. Then the Data line changes from its baseline value to write data into the pixel of the previous row, and returns to its baseline. This has no net effect on the pixel under consideration.

The second phase is an auto-zero phase. The AZ and SELECT lines for the present row go high, turning "on" transistors 340 and 350 and causing the gate of transistor N1 310 to drop, self-biasing to a turn-on voltage that permits a very small trickle of current to flow through the LED. In this phase the sum of the turn-on voltage of the LED and the threshold voltage of N1 are stored on the gate of N1. Since N1 and N2 can be placed very close together, their initial threshold voltages will be very similar. In addition, these two transistors should have the same gate to source voltage, Vgs. Since a TFT threshold drift depends only on Vgs over the life of the TFT, it can be assumed that the threshold voltages of these devices will track over the life of the TFT. Therefore, the threshold voltage of N2 is also stored on its gate. After auto-zeroing is complete, the Autozero line returns low, while Select line stays high.

The third phase is a data writing phase. The data is applied as a voltage above the baseline voltage on the Data line, and is written into the pixel through the capacitor. Then, the Select line returns low, and the sum of the data voltage, plus the LED turn-on voltage, plus N2's threshold voltage, is stored at node B for the rest of the frame. It should be noted that a capacitor from node B to +Vdd can be employed in order to protect the stored voltage from leaking away.

In sum, during the auto-zero phase, the LED's turn-on voltage, as well as N2's threshold voltage, are "measured" and stored at node B using a trickle current. This auto-zero phase is essentially a current-drive mode of operation, where the drive current is very small. It is only after the auto-zero phase, in the writing phase, that the voltage on the LED is incremented above turn-on using the applied data voltage. Thus, the present invention can be referred to as having a "hybrid drive," rather than a voltage drive or current drive. The hybrid drive method combines the advantages of voltage drive and current drive, without the disadvantages of either. Variations in the turn-on voltage of the LED and the threshold voltage of the TFT are corrected, just as in current drive. At the same time, all lines on the display are driven by voltages, and can therefore be driven fast.

It should be noted that the data voltage increment applied to the Data line 360 does not appear directly across the LED 304, but is split between Vgs of N2 320 and the LED. This simply means that there is a nonlinear mapping from the data voltage to the LED voltage. This mapping, combined with the nonlinear mapping from LED voltage to LED current, yields the overall transfer function from data voltage to LED current, which is monotonic, and, as noted above, is stable over the life of the display.

An advantage of the present pixel architecture 300 is that the transistors in the pixel whose threshold shifts are uncorrected (N3, N4, and N5) are turned on for only one row-time per frame, and therefore have a very low duty-cycle and are not expected to shift appreciably. Additionally, N2 is the only transistor in the LED's current path. Additional transistors connected in series on this path may degrade display efficiency or may create problems due to uncorrected TFT threshold shifts, and, if shared by all pixels on a column, may introduce significant vertical crosstalk.

Select and Autozero (AZ) pulses are generated by row scanners. The column data is applied on top of a fixed (and arbitrary) baseline voltage in the time-slot between AZ pulses. The falling edge of Select signal occurs while data is valid on the Data line. Various external and integrated column-scanner designs, either of the direct-sample or chopped-ramp type, can produce data with this timing.

The above pixel architecture permits large direct-view displays to be built using organic LEDs. Of course, the present pixel structure is also applicable to any display technology that uses display elements requiring drive current, particularly, when the display elements or the TFTs have turn-on voltages that shift or are nonuniform.

Figure 5:
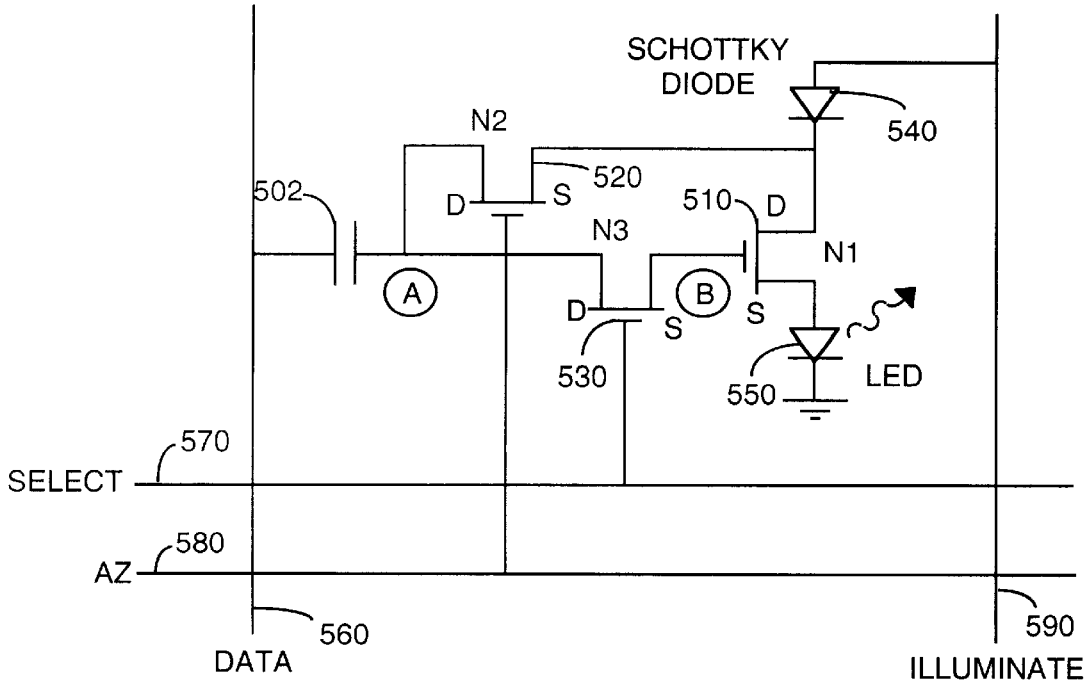
FIG. 5 depicts a schematic diagram of an alternate embodiment of an active matrix LED pixel structure of the present invention.

FIG. 5 depicts a schematic diagram of an alternate embodiment of an active matrix LED pixel structure 500 of the present invention. The pixel structure 500 is similar to the pixel structure 300 of FIG. 3, where a Schottky diode is now employed in lieu in of two transistors.

One potential disadvantage of the pixel structure 300 is the use of five transistors per pixel. Namely, using so many transistors in each pixel may impact the pixel's fill-factor (assuming bottom-side emission through the active plate), and also its yield. As such, the pixel structure 300 employs a single Schottky diode in each pixel that reduces the number of transistors from five to three transistors, while performing the same functions as previously described.

Referring to FIG. 5, pixel structure 500 comprises three NMOS transistors N1 (510), N2 (520), N3 (530), a capacitor 502, a Schottky diode 540 and a LED (OLED) 550 (light element). A Select line 570 is coupled to the gate of transistor 530. A Data line 560 is coupled to one terminal of the capacitor 502. An Autozero line 580 is coupled to the gate of transistor 520. An Illuminate (similar to a VDD line) line 590 is coupled to one terminal of the Schottky diode 540.

One terminal of the capacitor 502 is coupled (at node A) to the drain of transistors 520 and 530. The source of transistor 530 is coupled (at node B) to the gate of transistor 510. The drain of transistor 510 is coupled to the source of transistor 520, and one terminal of the Schottky diode 540.

Figure 6:
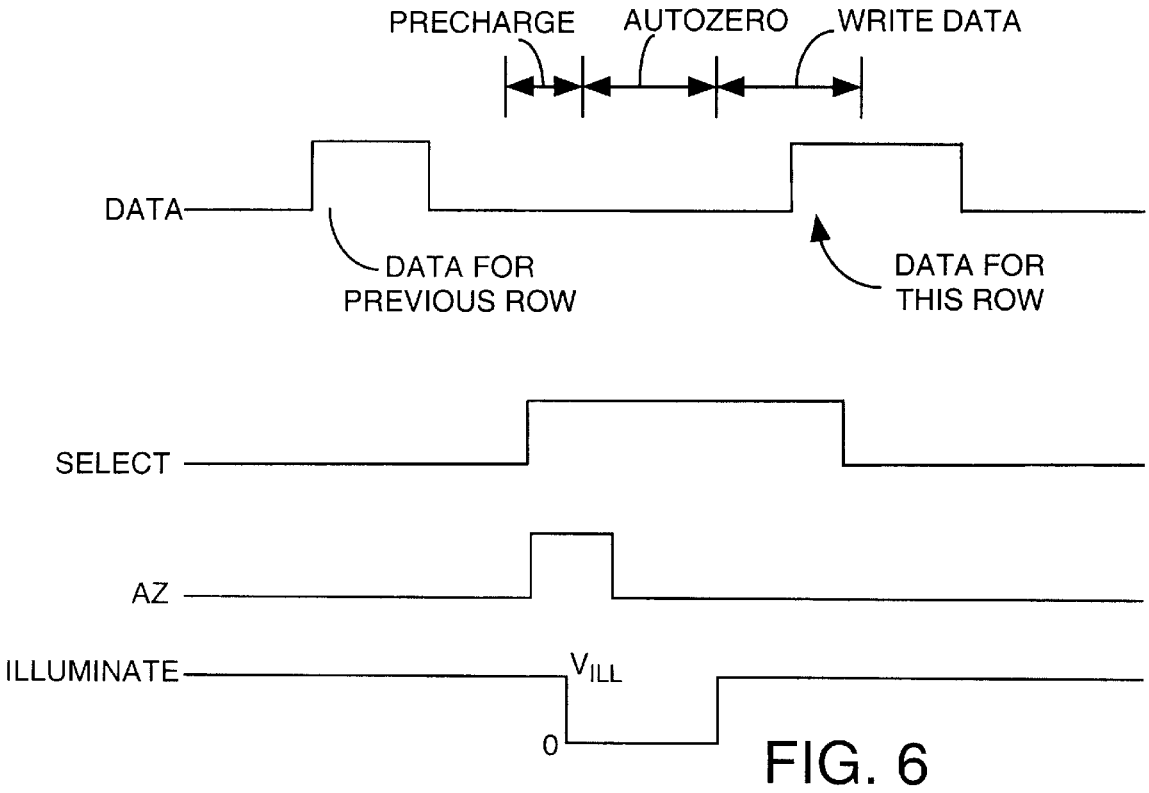
FIG. 6 depicts a timing diagram for active matrix LED pixel structure of FIG. 5.

The pixel structure 500 also has three phases of operation: a precharge phase, an autozero phase, and a data writing phase as discussed below. All of the Illuminate lines are connected together at the periphery of the display, and before the precharge phase begins, the Illuminate lines are held at a positive voltage $V_{ILL}$, which is approximately +15V. For the purpose of the following discussion, a row under consideration is referred to as "row i". The waveforms on each line are also shown in FIG. 6.

The first phase is a precharge phase. Precharge is initiated when the Autozero (AZ) line turns on transistor N2, and the Select line turns on transistor N3. This phase is performed while the Data line is at a reset level. The voltage at Nodes A and B rises to the same voltage as the drain of transistor N1, which is a diode drop below $V_{ILL}$.

The second phase is an autozero phase. Next, the Illuminate line drops to ground. During this phase, all pixels on the array will briefly darken. Autozeroing of N1 now begins with the Schottky diode 540 causing the drain of transistor N1 to be isolated from the grounded Illuminate line. When Node B has reached a voltage approximately equal to the threshold voltage of the transistor N1 plus the turn-on voltage of the LED 550, the AZ line is used to turn transistor N2 "off", and the Illuminate line is restored to $V_{ILL}$. All pixels in unselected rows light up again.

The third phase is a data writing phase. Next, the data for row i is loaded onto the data line. The voltage rise at Nodes A and B will equal the difference between the Data line's reset voltage level and the data voltage level. Thus, variations in the threshold voltage of transistor N1 and the Led's turn-on voltage will be compensated. After the voltage at Node B has settled, the Select line for row i is used to turn off transistor N3, and the Data line is reset. The proper data voltage is now stored on the pixel until the next frame.

Thus, a three-transistor pixel for OLED displays has been described, that possesses the advantages described previously for the 5-transistor pixel 300, but requires fewer transistors. An additional advantage is that the 5-transistor pixel employs separate transistors for autozeroing and driving the LED. Proper operation of pixel 300 requires that these two transistors have matching initial thresholds that would drift over life in the same way. Recent experimental data suggest that TFTs with different drain voltages (as these two transistors have) may not drift in the same way. Thus, pixel 500 performs autozeroing on the same transistor that drives the LED, such that proper autozeroing is guaranteed.

Figure 7:
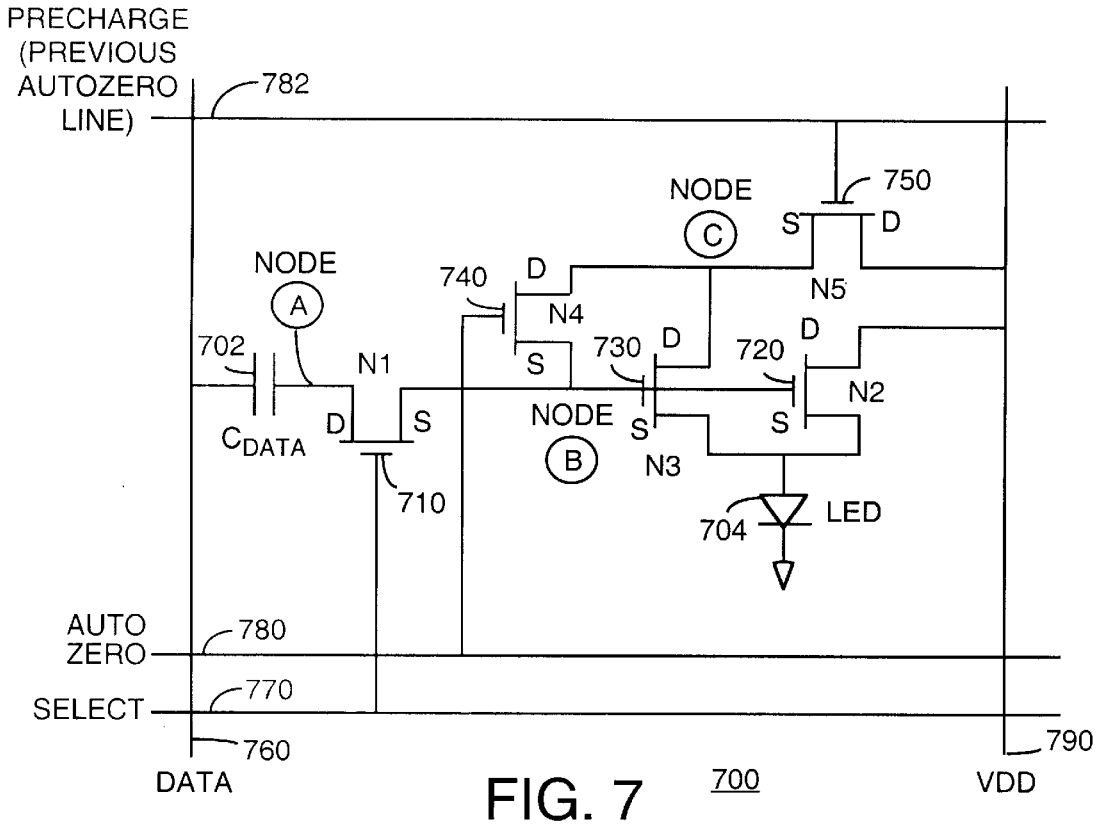
FIG. 7 depicts a schematic diagram of an alternate embodiment of an active matrix LED pixel structure of the present invention.

FIG. 7 depicts a schematic diagram of an alternate embodiment of an active matrix LED pixel structure 700 of the present invention. The pixel structure 700 is similar to the pixel structure 300 of FIG. 3, with the exception that pixel structure 700 may generate a more precise autozero voltage.

Namely, referring to FIG. 3, the autozeroing arises from the fact that each precharge cycle, as shown in FIG. 3, injects a large positive charge $Q_{PC}$ onto Node A of the pixel 300. During the precharge phase, nearly all of the capacitance on Node A is from capacitor $C_{data}$, such that the charge injected onto Node A is:

$$Q_{PC} \equiv C_{data}(V_{DD} - V_A) \tag{1}$$

where $V_A$ is the voltage that was on Node A before the precharge phase began. $V_A$ depends on the threshold voltage of N3 330 and the turn-on voltage of the LED 304, as well as the previous data applied to the pixel 300. Since $C_{data}$ is a large capacitance (approx. 1 pF), $Q_{PC}$ is also relatively large, on the order of ten picocoulombs.

When the pixel 300 is at a stable autozero level, $Q_{PC}$ flows through N1 310 and the LED 304 during the autozero phase. Since the autozero interval is short (approximately 10 $\mu$sec.), N1 may be left with a gate-to-source autozero voltage higher than its threshold voltage, and similarly the LED autozeroes above its turn-on voltage. Thus, the autozeroing process may not produce a true zero-current autozero voltage at Nodes A and B, but instead, an approximation of a zero-current autozero voltage.

It should be noted that it is not necessary to produce a true zero-current autozero voltage, corresponding to exactly zero current through N1 and the LED. The desirable goal is to obtain an autozero voltage that permits a small trickle of current (approximately ten nanoamps) to flow through N1 310 and the LED 304. Since the autozero interval is approximately 10 $\mu$sec, then $Q_{PC}$ should be on the order of 0.1 picocoulomb. As noted above, $Q_{PC}$ is approximately 10 picocoulombs.

The effect of such a large $Q_{PC}$ is that the pixel's stable autozero voltage may well be above the sum of the threshold and turn-on voltages. This condition by itself is not a problem, if the excess autozero voltages were uniform across the display. Namely, the effect can be addressed by offsetting all the data voltages accordingly.

However, a potential difficulty may arise if $Q_{PC}$ is not only large, but also depends on the previous data voltage, and on the autozero voltage itself. If this condition develops in the display, then not only will all pixels have large excess autozero voltages, but also the magnitude of the excess voltage may vary from pixel to pixel. In effect, the autozeroing of pixel 300 may not produce a uniform display under such a condition.

To address this criticality, the pixel structure 700 is capable of reducing the precharge $Q_{PC}$ to a very small value. Additionally, a "variable precharge" method is disclosed, that permits $Q_{PC}$ to vary, depending on the amount of charge that is actually needed for autozeroing. In brief, if the current autozero voltage is too low, $Q_{PC}$ assumes its maximum value of about 0.1 picocoulomb in order to raise the autozero voltage toward its desired value. However, if the current autozero voltage is too high, then $Q_{PC}$ is essentially zero, allowing the autozero voltage to drop quickly.

Referring to FIG. 7, pixel structure 700 comprises five NMOS transistors N1 (710), N2 (720), N3 (730), N4 (740), N5 (750), a capacitor 702, and a LED (OLED) 704 (light element). A Select line 770 is coupled to the gate of transistor 710. A Data line 760 is coupled to one terminal of the capacitor 702. An Autozero line 780 is coupled to the gate of transistor 740. A VDD line 790 is coupled to the drain of transistors 720 and 750. An Autozero line 782 from a previous row in the pixel array is coupled to the gate of transistor 750.

It should be noted that Autozero line 782 from a previous row can be implemented as a second Select line. Namely, the timing of the present pixel is such that the Autozero line 782 from a previous row can be exploited without the need of a second Select line, thereby reducing complexity and cost of the present pixel.

One terminal of the capacitor 702 is coupled (at node A) to the drain of transistor 710. The source of transistor 710 is coupled (at node B) to the gate of transistors 720 and 730 and is coupled to the source of transistor 740. The drain of transistor 740 is coupled (at node C) to the source of transistor 750, and to the drain of transistor 730. Finally, the source of transistors 730 and 720 are coupled to one terminal of the LED 704.

Figure 8:
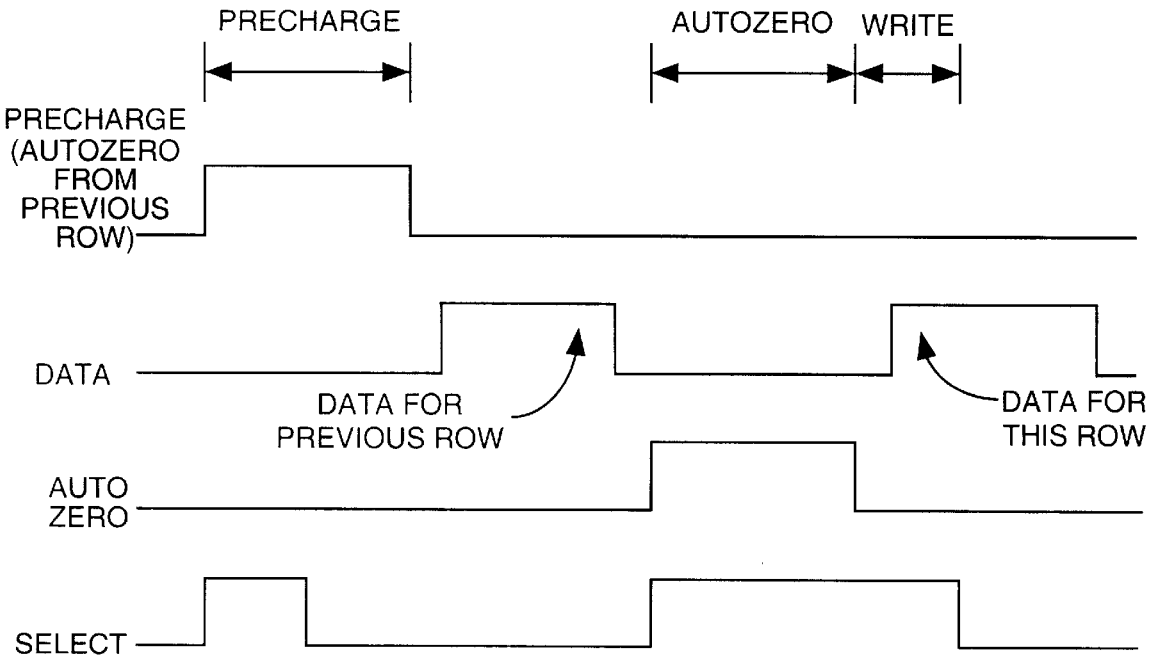
FIG. 8 depicts a timing diagram for active matrix LED pixel structure of FIG. 7.

More specifically, the pixel 700 is similar to the pixel 300, except that the precharge voltage is now applied to Node C, which is the drain of transistor N3 730. In addition, there are also some timing changes as shown in FIG. 8. The operation of the pixel 700 is again described below in three phases or stages.

The first phase is a precharge phase that occurs during the previous line time, i.e., before data is applied to the previous row's pixels. A positive pulse on the Select line turns "on" N1, thereby shorting Nodes A and B together, which returns the pixel 700 to the state it was in after the last autozero phase. Namely, the pixel is returned to a data-independent voltage that is the pixel's most recent estimate of its proper autozero voltage. While transistor N1 is "on", a positive pulse on the Autozero line 782 from a previous row line turns "on" transistor N5, thereby precharging Node C to $V_{dd}$. In turn, transistors N1 and N5 are turned "off".

The relative timing of turning transistors N1 and N5 "on" and "off" is not very important, except that transistor n1 must be "on" before transistor N5 is turned "off". Otherwise, transistor N3 may still be turned "on" in response to the old data voltage, and the charge injected onto Node C may inadvertently drain away through transistor N3.

After the precharge phase, the charge $Q_{PC}$ is stored at Node C on the gate-to-source/drain capacitances of transistors N3, N4 and N5. Since these capacitances add up to a very small capacitance (about 10 fF), and the precharge interval raises Node C about 10V, $Q_{PC}$ is initially approximately 0.1 picocoulombs. However, this charge will drain from Node C to varying degrees prior to the autozero phase, depending on how well the previous autozero voltage approximates the true autozero voltage.

Thus, it is more accurate to indicate that $Q_{PC} \leqq 0.1$ picocoulomb, depending on how much charge is needed for autozeroing. This is the variable precharge feature. If the last autozero voltage is too low, N3 is nonconducting after the precharge phase, and $Q_{PC}$ should stay at its maximum value, raising the autozero voltage toward its desired level during the autozero phase. If the last autozero voltage is too high, N3 is conducting, and $Q_{PC}$ will drain off by the time the autozero phase occurs, allowing the autozero voltage to drop quickly.

Although the relative timing for transistors N1 and N5 is not critical, the preferred timing is shown in FIG. 8. The two transistors N1 and N5 turn "on" at the same time in order to minimize the time required for precharge. N1 turns "off" before N5 such that the (intentional) draining of $Q_{PC}$ from Node C is in response to a Node B voltage that has been capacitively pushed down by N1 turning "off". This ensures that the draining of $Q_{PC}$ from Node C is in response to a Node B voltage that is the same as when zero data is applied to the pixel.

In sum, the pixel 700 when compared to the pixel 300, provides a means of precharging the pixel that allows a more effective autozeroing. Specifically, the autozeroing of pixel 700 is more accurate, faster, and data independent. Computer simulations have verified that the pixel 700 autozeroes well and is able to maintain a nearly constant OLED current vs. data voltage characteristic over an operational lifetime of 10,000 hours.

Figure 9:
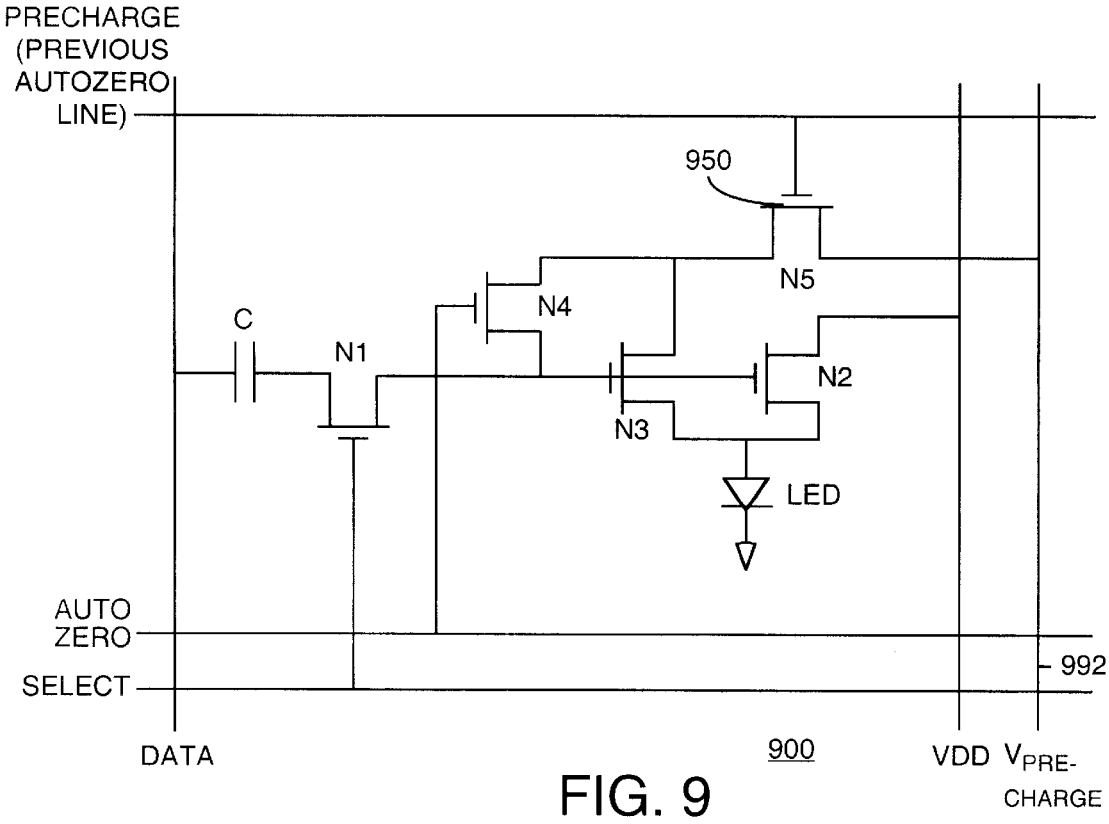
FIG. 9 depicts a schematic diagram of an alternate embodiment of an active matrix LED pixel structure of the present invention.

FIG. 9 depicts a schematic diagram of an alternate embodiment of an active matrix LED pixel structure 900 of the present invention. The pixel structure 900 is similar to the pixel structure 700 of FIG. 7, with the exception of having an additional $V_{precharge}$ line 992, that permits the range of autozero voltages to be extended without raising the LED supply voltage $V_{dd}$. This additional modification of the pixel extends the life and efficiency of the pixel.

It should be noted that the above described pixels (200, 300, 700) have the limitation that the autozero voltage cannot exceed $V_{dd}$, since this is the precharge voltage. However, as the threshold voltages of transistors N2 and N3 drift over the life of the transistor, a point is reached where an autozero voltage higher than $V_{dd}$ is required in order to compensate for drift in the TFT threshold voltage and in the OLED turn-on voltage. Since the autozero voltage cannot reach higher voltages, display uniformity will quickly degrade, signaling the end of the useful life of the display. Raising $V_{dd}$ will permit higher autozero voltages to be achieved, but at the expense of power efficiency, since $V_{dd}$ is also the OLED drive supply.

Furthermore, the range of autozero voltages will be restricted even further if, in order to improve power efficiency, $V_{dd}$ is reduced to operate transistor N2 in the linear region. (Of course, this will require N2 to be made larger than if it was operated in saturation.) In this case, the operating lifetime will be quite short, since after a short period of operation, the autozero voltage will need to reach a level higher than $V_{dd}$.

Referring to FIG. 9, an optional modification is incorporated into the pixel 700 that removes restrictions on the autozero voltage, thereby permitting it to be extended to well above $V_{dd}$. The pixel 900 is identical to the pixel 700 with the exception of an additional column line 992, that is coupled to the drain of transistor 950.

The column line 992 is added to the array to carry a DC voltage $V_{precharge}$ to all the pixels. All of these column lines are connected together at the edge of the display. By raising $V_{precharge}$ to a level higher than $V_{dd}$, the pixel 900 can precharge and autozero to a voltage higher than $V_{dd}$. A high value of $V_{precharge}$ will have very little effect on display efficiency.

It should be noted that each $V_{precharge}$ line 992 can be shared by neighboring columns of pixels. The $V_{precharge}$ lines can also run as row lines, shared by neighboring rows.

In sum, a modification of the above OLED pixels is disclosed where an additional voltage line is provided to extend the range of the autozero voltages beyond $V_{dd}$. This allows the OLED drive transistor to operate at as low a voltage as needed for power efficiency, possibly even in the linear region, without restricting the range of autozero voltages. Thus, long operating lifetime and high efficiency can be obtained. Finally, although the present modification is described with respect to pixel 700, it should be understood that this optional modification can be employed with other autozeroing pixel structures, including but not limited to, pixels 200 and 300 as discussed above.

Although the above pixel structures are designed for an OLED display in such a manner that transistor threshold voltage variations and OLED turn-on voltage variations in the pixel can be compensated, these pixel structures are not designed to address nonuniformity that is generated external to the pixel. It was pointed out that the pixel could be used with conventional column driver circuits, either external to the display plate or integrated on the display.

Unfortunately, integrated data drivers are typically not as accurate as external drivers. While commercially available external drivers can achieve ±12 mV accuracy, it has proven difficult to achieve accuracy better than ±50 mV using integrated drivers. The particular type of error produced by integrated drivers is primarily offset error, i.e., it is a data-independent DC level that adds to all data voltages. The offset error is nonuniform, i.e., the value of the DC level varies from one data driver to the next. Liquid crystal displays tend to be forgiving of offset errors because the liquid crystal is driven with opposite polarity data in successive frames, such that in one frame the offset error causes the liquid crystal to be slightly too dark, and in the next frame too light, but the average is nearly correct and the alternating errors are not noticeable to the eye. However, an OLED pixel is driven with unipolar data. Therefore, the bipolar cancellation of offset errors does not occur, and serious nonuniformity problems may result when integrated scanners are used.

Figure 10:
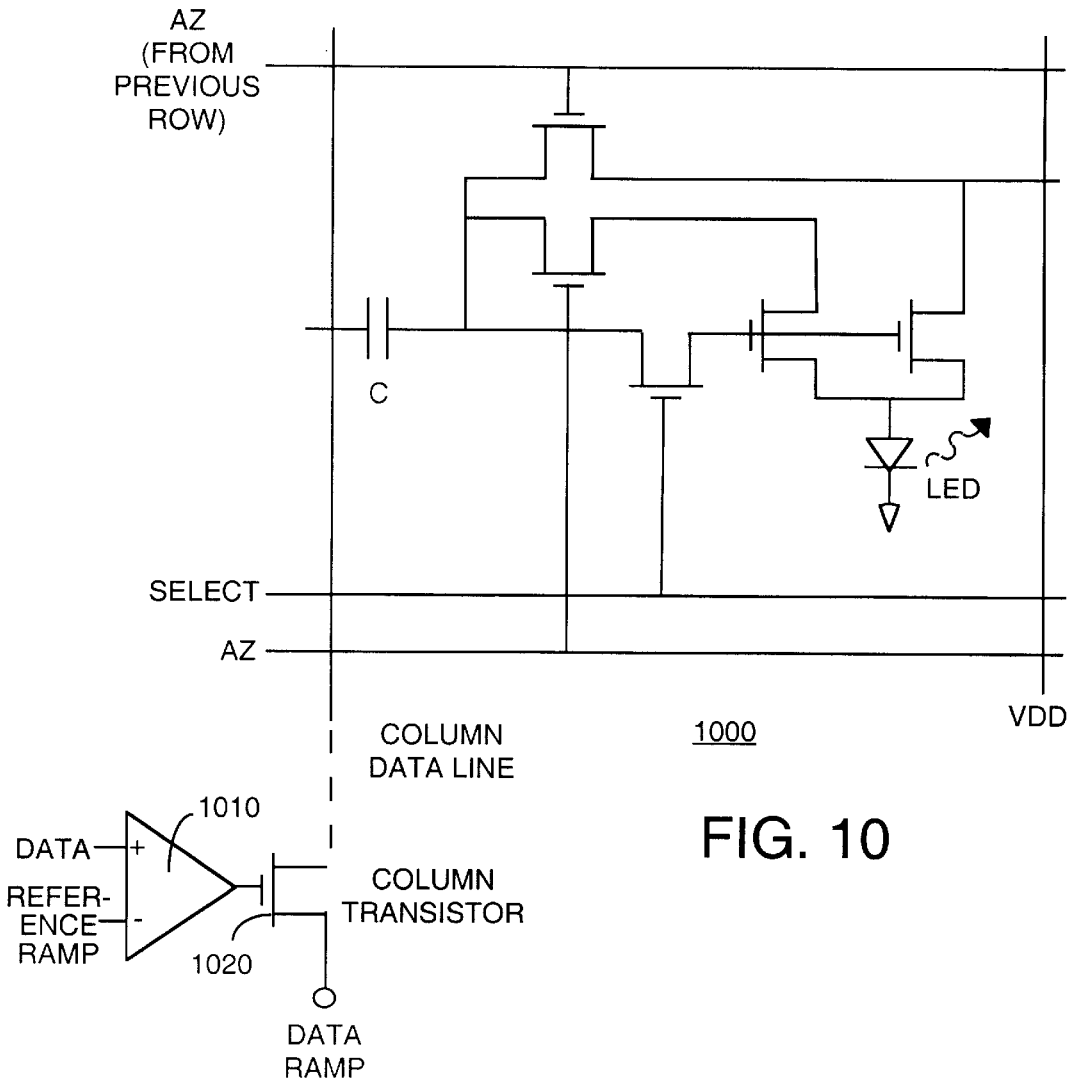
FIG. 10 depicts a schematic diagram of an alternate embodiment of an active matrix LED pixel structure of the present invention.

FIG. 10 depicts a schematic diagram of an active matrix LED pixel structure 300 of the present invention coupled to a data driver 1010 via a column transistor 1020. The present invention describes a method for canceling offset errors in integrated data scanners for OLED displays. Namely, the present method is designed to operate with any pixel in which the pixel is capacitively coupled to a data line, and has an autozero phase, e.g., pixels 200, 300, 500, and 700 as discussed above.

Referring to FIG. 10, the pixel 300 as described above is coupled to a Data line that provides the pixel with an analog level to establish the brightness of the OLED element. In FIG. 10, the Data line is driven by a data driver that uses the chopped ramp technique to set the voltage on the Data line. Various sources of error exist in this approach that may give rise to offset errors on the Data line. For example, the time at which the voltage comparator switches can vary depending on the comparator's maximum slew rate. It has also been observed experimentally that the maximum slew rate can be highly variable. The offset error will affect the voltage stored in the pixel. Since it is nonuniform, the offset error will also lead to brightness variations across the display.

Figure 11:
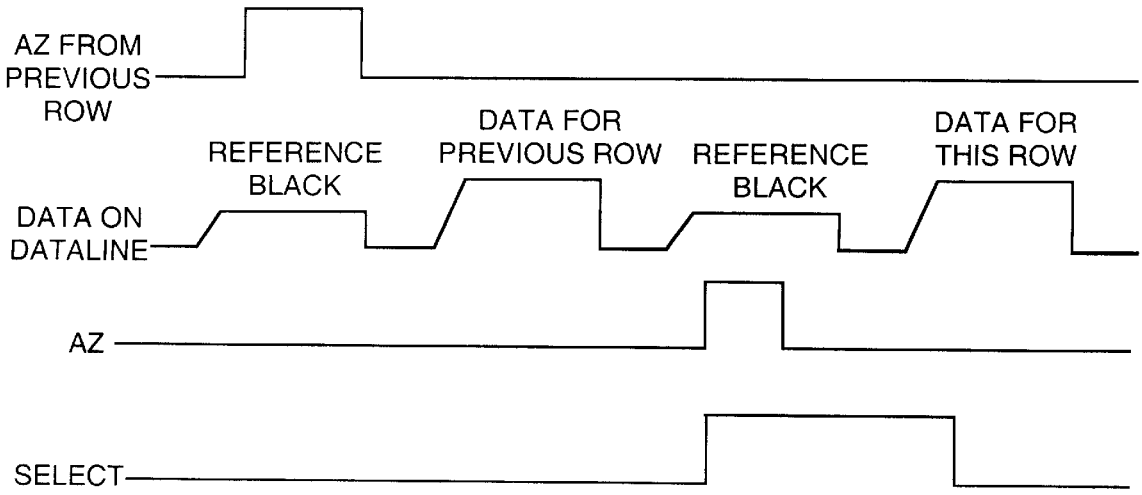
FIG. 11 depicts a timing diagram for active matrix LED pixel structure of FIG. 10.

In the present invention, the period during which the pixel autozeros to cancel its own internal threshold error is also used to calibrate out the data scanner's offset error. The waveforms of the various lines is shown in FIG. 11.

Namely, this is accomplished by setting a reference black level on the Data line using the same column driver that will apply the actual data voltage. This reference black level, applied during the pixel's autozero phase, is set on the Data line in exactly the same manner that the actual data voltage will be set: the data ramp is chopped at a time determined by the voltage comparator. Thus, the voltage across capacitor C of the pixel is determined by the difference between the pixel's turn-on voltage and the combined black level plus the offset error voltage. The reference black level is maintained for the entire autozero phase. When the actual data is applied to the pixel, the data scanner offset error is now canceled by the stored voltage on the pixel capacitor.

This technique can be applied not only to integrated scanners that use a chopped ramp, but also to scanners using direct sampling onto the columns. In the case of direct sampling, the error arises from the nonuniform capacitive feedthrough of the gate signal onto the Data line when the (large) column transistor turns off. Variations in the threshold voltage of this transistor produce a nonuniform offset error, just like the nonuniform offset error produced by the chopped ramp data scanners.

Thus, it can be corrected in the same manner. A black reference voltage is written onto the columns during the pixel's autozero phase. Since all of the pixels in a row autozero at the same time, this black level is written onto all of the data columns simultaneously at the beginning of the line time. The black level is maintained for the entire autozero phase. As in the case of the chopped-ramp scanner, when the actual data is applied to the pixel, the offset error will be canceled by the voltage stored on the pixel capacitor. However, it seems likely that the time overhead required to perform offset error correction is smaller using the direct-sampling technique than with the chopped ramp technique.

The present method for correcting data driver errors should permit organic LED displays to be built with much better brightness uniformity than would otherwise be possible. Using the method described here, together with any of the above autozeroing pixels, brightness uniformity of 8-bits should be achievable, with no visible uniformity degradation over the lifetime of the display.

Although the above disclosure describes a plurality of pixel structures that can be employed to account for non-uniformity in the intensity of a display, an alternative approach is to compensate such nonuniformity by using external means. More specifically, the disclosure below describes an external calibration circuit and method to account for nonuniformity in the intensity of a display. In brief, the non-uniformity is measured and stored for all the pixels such that the data (e.g., data voltages) can be calibrated using the measured non-uniformity.

Figure 2:
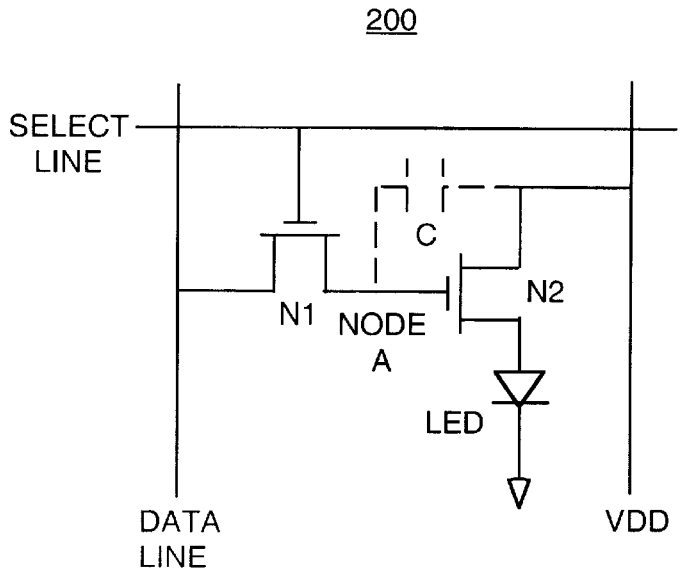
(PRIOR ART) FIG. 2
FIG. 2 depicts a schematic diagram of a prior art active matrix LED pixel structure.

As such, although the conventional pixel structure of FIG. 2 is used in the following discussion, it should be understood that the present external calibration circuit and method can be employed with other pixel structures, including but not limited to, the pixels 300, 500, and 700 as described above. However, if the non-uniformity is addressed by the present external calibration circuit and method, then a more simplified pixel structure can be employed in the display, thereby increasing display yield and fill-factor.

Figure 12:
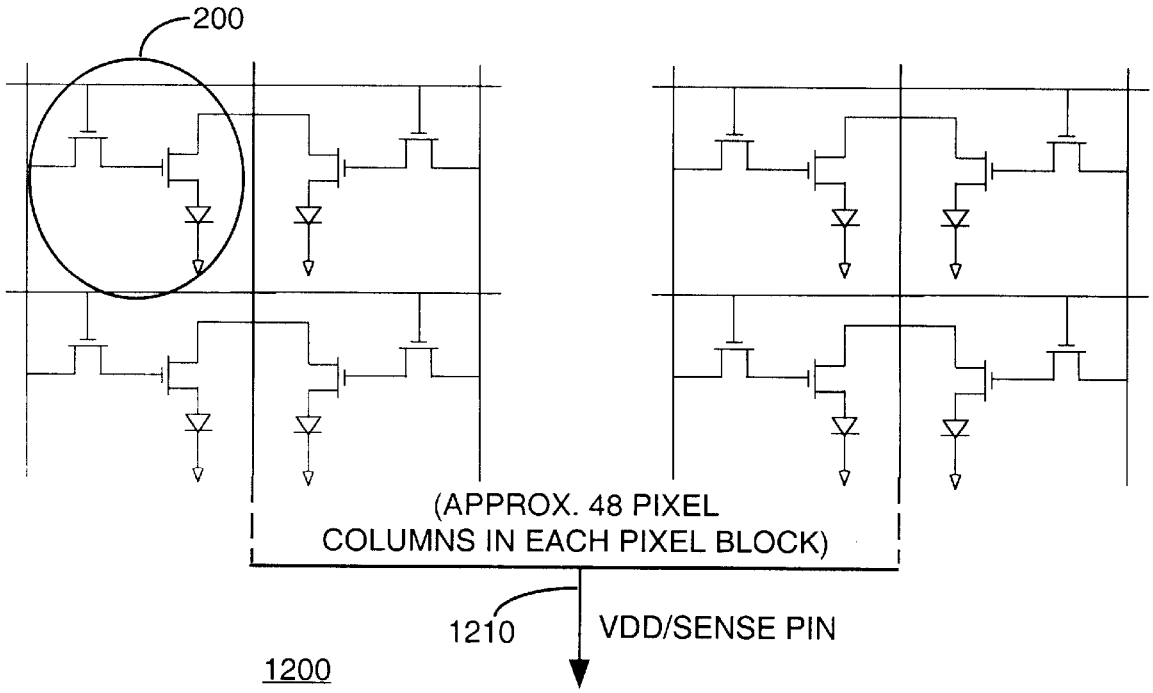
FIG. 12 illustrates a schematic diagram of an array of pixels interconnected into a pixel block.

FIG. 12 illustrates a schematic diagram of an array of pixels 200 interconnected into a pixel block 1200. Referring to FIG. 2, in operation, data is written into the pixel array in the manner commonly used with active matrix displays. Namely, a row of pixels is selected by driving the Select line high, thereby turning on access transistor N1. Data is written into the pixels in this row by applying data voltages to the Data lines. After the voltage at node A has settled, the row is deselected by driving the Select line low. The data voltage is stored at node A until this row is selected again on the next frame. There may be some charge leakage from node A during the time that N1 is turned off, and a storage capacitor may be required at node A to prevent an unacceptable level of voltage decay. The dotted lines illustrate how a capacitor can be connected to address the voltage decay. However, it is possible that there is sufficient capacitance associated with the gate of N2 to render such additional capacitance unnecessary.

It should be noted that the luminance L of an OLED is approximately proportional to its current I, with the constant of proportionality being fairly stable and uniform across the display. Therefore, the display will be visually uniform if well-defined OLED currents are produced.

However, what is programmed into the pixel is not the OLED current, but rather the gate voltage on N2. It is expected that TFT threshold voltages and transconductances will exhibit some initial nonuniformity across a display, as will the OLED electrical parameters. Furthermore, it is well known that TFT threshold voltages increase under bias-temperature stress conditions, as do OLED turn-on voltages. Thus, these parameters are expected to be initially nonuniform, and to vary over the life of the pixel in a manner that depends on the individual bias history of each pixel. Programming the gate voltage of N2 without compensating for the variations of these parameters will yield a display that is initially nonuniform, with increasing nonuniformity over the life of the display.

The present invention describes a method for correcting the data voltage applied to the gate of N2 in such a way that variations in the TFT and OLED electrical parameters are compensated, thereby permitting well-defined OLED currents to be produced in the pixel array.

FIGS. 2 and 12 illustrate a pixel array having VDD supply lines that are disposed parallel to the Data lines. (In alternative embodiments, the VDD lines may run parallel to the Select lines.) As such, each VDD line can be shared by two or more neighboring columns of pixels to reduce the number of VDD lines. FIG. 12 illustrates the VDD lines as being tied together into blocks on the periphery of the display. Each pixel block 1200 may contain as few as one VDD line, or as many as the total number of VDD lines on the display. However, in the preferred embodiment, each pixel block 1200 contain about 24 VDD lines, i.e., about 48 pixel columns.

Figure 13:
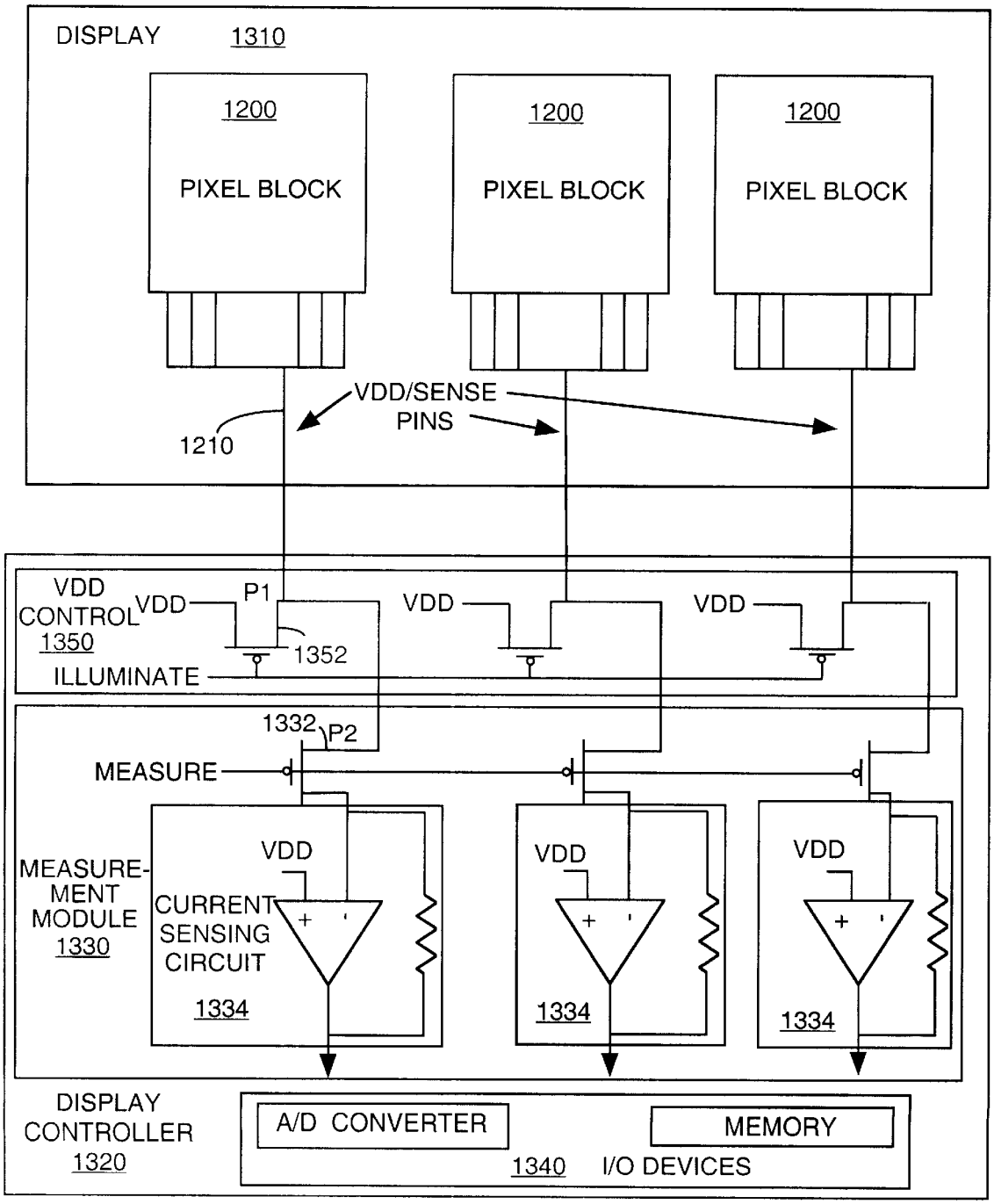
FIG. 13 is a schematic diagram illustrating the interconnection between a display and a display controller.

FIG. 13 is a schematic diagram illustrating the interconnection between a display 1310 and a display controller 1320. The display 1310 comprises a plurality of pixel blocks 1200. The display controller 1320 comprises a VDD control module 1350, a measurement module 1330 and various I/O devices 1340 such as A/D converters and a memory for storing pixel parameters.

Each pixel block is coupled to a sensing pin (VDD/SENSE) 1210 at the edge of the display, as shown in FIGS. 12 and 13. During normal display operation, the sensing pins 1210 are switched to an external $V_{dd}$ supply, e.g., between 10–15V, thereby supplying current to the display for illuminating the OLED elements. More specifically, each VDD/SENSE pin 1210 is associated with a pair of p-channel transistors P1 (1352) and P2 (1332) and a current sensing circuit 1334 in the display controller 1320. During normal operation, an ILLUMINATE signal from the display controller activates P1 to connect a VDD/SENSE pin to the $V_{dd}$ supply. In a typical implementation, the current through P1 is expected to be approximately 1 mA per column.

In order to compensate for variations in the TFT and OLED parameters, the external current sensing circuits 1334 are activated via a MEASURE signal to collect information about each pixel's parameters during a special measurement cycle. The collected information is used to calculate or adjust the appropriate data voltages for establishing the desired OLED currents during normal display operation.

More specifically, during a given pixel's measurement cycle, all other pixels in the pixel block are tuned off by loading these pixels with low data voltages (e.g., zero volts or less), thereby ensuring negligible current draw from the "off" pixels. In turn, the current drawn by the pixel of interest is measured in response to one or more applied data voltages. During each measurement cycle, the data pattern (i.e., consisting of all pixels in a block turned "off" except for one pixel turned "on") is loaded into the pixels in the normal way, with data applied to the DATA lines by data driver circuits, and rows being selected one by one. Thus, since the display is partitioned into a plurality of pixel blocks, a plurality of pixels can be measured by turning on at least one pixel in each pixel block simultaneously.

The current drawn by the pixel of interest in each pixel block is measured externally by driving the ILLUMINATE and MEASURE lines to levels that disconnect the VDD/SENSE pin 1210 from VDD source and connect the sensing pin to the input of a current-sensing circuit 1334 through P2, where the current drawn by the pixel of interest is measured. The pixel current is expected to be in the range of 1–10 $\mu$A. The current-sensing circuit 1334 is shown as a transimpedance amplifier in FIG. 13, but other embodiments of current-sensing circuit can be implemented. In the present invention, the amplifier generates a voltage at the output that is proportional to the current at the input. This measured information is then collected by I/O devices 1340 where the information is converted into digital form and then stored for calibrating data voltages. The resistor in the current-sensing circuit 1334 is approximately one Megohm.

Although multiple current-sensing circuits 1334 are illustrated with a one to one correspondence with the pixel blocks, fewer current-sensing circuits can be employed through the use of a multiplexer (not shown). Namely, multiple VDD/SENSE pins are multiplexed to a single current-sensing circuit 1334. In one extreme, a single current-sensing circuit is used for the entire display. Multiplexing the VDD/SENSE pins to the sensing circuits in this manner reduces the complexity of the external circuitry, but at the expense of added display measurement time.

Since normal display operation must be interrupted in order to perform pixel measurement cycles, pixel measurements should be scheduled in a manner that will least disrupt the viewer. Since the pixel parameters change slowly, a given pixel does not need to be measured frequently, and measurement cycles can be spread over a long period of time.

While it is not necessary for all pixels to be measured at the same time, it is advantageous to do so in order to avoid nonuniformity due to variable measurement lag. This can be accomplished by measuring all pixels rapidly when the display module is turned "on", or when it is turned "off". Measuring pixels when the display module is turned "off" does not interfere with normal operation, but may have the disadvantage that after a long "off" period, the stored pixel parameters may no longer ensure uniformity. However, if an uninterrupted power source is available (e.g., in screen saver mode), measurement cycles can be performed periodically while the display is "off" (from the user's point of view). Of course, any option that does not include a rapid measurement of all pixels when the display module is turned "on", requires that nonvolatile memory be available for storing measurement information while power is "off".

If pixel measurement information is available, compensation or calibration of the data voltages can be applied to the display to correct for various sources of display nonuniformity. For example, compensation of the data voltages can be performed to account for transistor threshold-voltage variations and OLED turn-on voltage variations. As such, the discussion below describes a plurality of methods that are capable of compensating the above sources of display nonuniformity, including other sources of display nonuniformity as well. By using these methods, a display with several sources of nonuniformity, some of them severe, can still provide a uniform, high-quality displayed image.

For the purpose of describing the present compensation methods, it is assumed that the pixel structure of FIG. 2 is employed in a display. However, it should be understood that the present compensation methods can be adapted to a display employing any other pixel structures.

Referring to FIG. 2, the stored voltage on Node A is the gate voltage of N2, and thus establishes a current through N2 and through the LED. By varying the gate voltage on N2, the LED current can be varied. Consider the relationship between the gate voltage on N2 and the current through the LED. The gate voltage $V_g$ can be divided into two parts, the gate-to-source voltage $V_{gs}$ of N2 and the voltage $V_{diode}$ across the LED:

$$V_g = V_{gs} + V_{diode} \tag{2}$$

For an MOS transistor in saturation the drain current is approximately:

$$I = \frac{k}{2}(V_{gs} - V_t)^2 \tag{3}$$

where k is the device transconductance parameter and $V_t$ is the threshold voltage. (For operation in the linear region, see below.) Therefore:

$$V_{gs} = \sqrt{\frac{2I}{k}} + V_t \tag{4}$$

The forward current through the OLED is approximately:

$$I = AV_{diode}^{\ m} \tag{5}$$

where A and m are constants (See Burrows et al., J. Appl. Phys. 79 (1996)). Therefore:

$$V_{diode} = \sqrt[m]{\frac{I}{A}} \tag{6}$$

Thus, the overall relation between the gate voltage and the diode current is:

$$V_g = V_t + \sqrt{\frac{2I}{k}} + \sqrt[m]{\frac{I}{A}} \tag{7}$$

It should be noted that other functional forms can be used to represent the OLED I-V characteristic, which may lead to different functional relationships between the gate voltage and the diode current. However, the present invention is not limited to the detailed functional form of the OLED I-V characteristic as disclosed above, and as such, can be adapted to operate for any diode-like characteristic.

The luminance L of an OLED is approximately proportional to its current I, with the constant of proportionality being fairly stable and uniform across the display. Typically, the display is visually uniform if well-defined OLED currents can be produced. However, as discussed above, the pixel is programmed with the voltage $V_g$ and not the current I.

The problem is based on the observation that TFT parameters $V_t$ and k will exhibit some initial nonuniformity across a display, as well OLED parameters A and m. Furthermore, it is well known that $V_t$ increases under bias-temperature stress conditions. The OLED parameter A is directly related to the OLED's turn-on voltage, and is known to decrease under bias stress. The OLED parameter m is related to the distribution of traps in the organic band gap, and may also vary over the life of the OLED. Thus, these parameters are expected to be initially nonuniform, and to vary over the life of the display in a manner that depends on the individual bias history of each pixel. Programming the gate voltage without compensating for the variations of these parameters will yield a display that is initially nonuniform, with increasing nonuniformity over the life of the display.

In fact, other sources of nonuniformity exists. The gate voltage $V_g$ is not necessarily equal to the intended data voltage $V_{data}$. Instead, gain and offset errors in the data drivers, as well as (data-dependent) feedthrough arising from the deselection of N1, may cause these two voltages to be different. These sources of error can also be nonuniform and can vary over the life of the display. These and any other gain and offset errors can be addressed by expressing:

$$V_g = BV_{data} + V_0 \tag{8}$$

where B and $V_0$ are a gain factor and an offset voltage, respectively, both of which can be nonuniform. Combining and simplifying equations (7) and (8) produces:

$$V_{data} = V_{off} + C\sqrt{I} + D\sqrt[m]{I} \tag{9}$$

where $V_{off}$, C, and D are combinations of the earlier parameters.

The present invention provides various compensation methods for correcting the intended (input) data voltage $V_{data}$ to compensate for variations in $V_{off}$, C, D, and m, thereby permitting well-defined OLED currents to be produced in the pixel array. In order to compensate for variations in the parameters $V_{off}$, C, D, and m, the external current sensing circuits as described above, collect information about each pixel's parameters, i.e., the current drawn by a single pixel can be measured externally. Using the measured information for the parameters $V_{off}$, C, D, and m, the present invention calculates the appropriate data voltages $V_{data}$ in accordance with equation (9), for establishing the desired OLED currents during normal display operation.

Alternatively, it should be noted that an exact calculation of the four parameters $V_{off}$, C, D, and m from current measurements is computationally expensive, thereby requiring complicated iterative calculations. However, good approximations can be employed to reduce computational complexity, while maintaining effective compensation.

In one embodiment, pixel nonuniformity is characterized using only two parameters instead of four as discussed above. Referring to the pixel's current-voltage characteristic of equation (9), at normal illumination levels, the $C\sqrt{I}$ term, associated with $V_{gs}$ of N2, and the $$D\sqrt[m]{I}$$

term, associated with $V_{diode}$, have roughly the same magnitude. However, their dependence on pixel current is very different. The value of m is approximately 10, such that at typical illumination levels, $$D\sqrt[m]{I}$$

is a much weaker function of I than is $C\sqrt{I}$.

For example, a 100 fold (100×) increase in I results in $C\sqrt{I}$ increasing by 10 fold (10×), but $$D\sqrt[m]{I}$$

increases only 1.58 fold (1.58×) (assuming m=10). Namely, at typical illumination current levels, the OLED's I-V curve is much steeper than the TFT's I-$V_{gs}$ curve.

As such, an approximation is made where at typical current levels, $$D\sqrt[m]{I}$$

is independent of current, and its pixel-to-pixel variation can be simply treated as an offset variation. While this approximation may introduce some error, the appearance of the overall display will not be significantly degraded. Thus, with a fair degree of accuracy all display nonuniformity can be treated as offset and gain variations. Thus, equation (9) can be approximated as:

$$V_{data} = V_{offset} + C\sqrt{I} \tag{10}$$

where $$V_{offset} = V_{off} + D\sqrt[m]{I}$$

now includes $$D\sqrt[m]{I},$$

and $V_{offset}$ and C vary from pixel to pixel.

Figure 14:
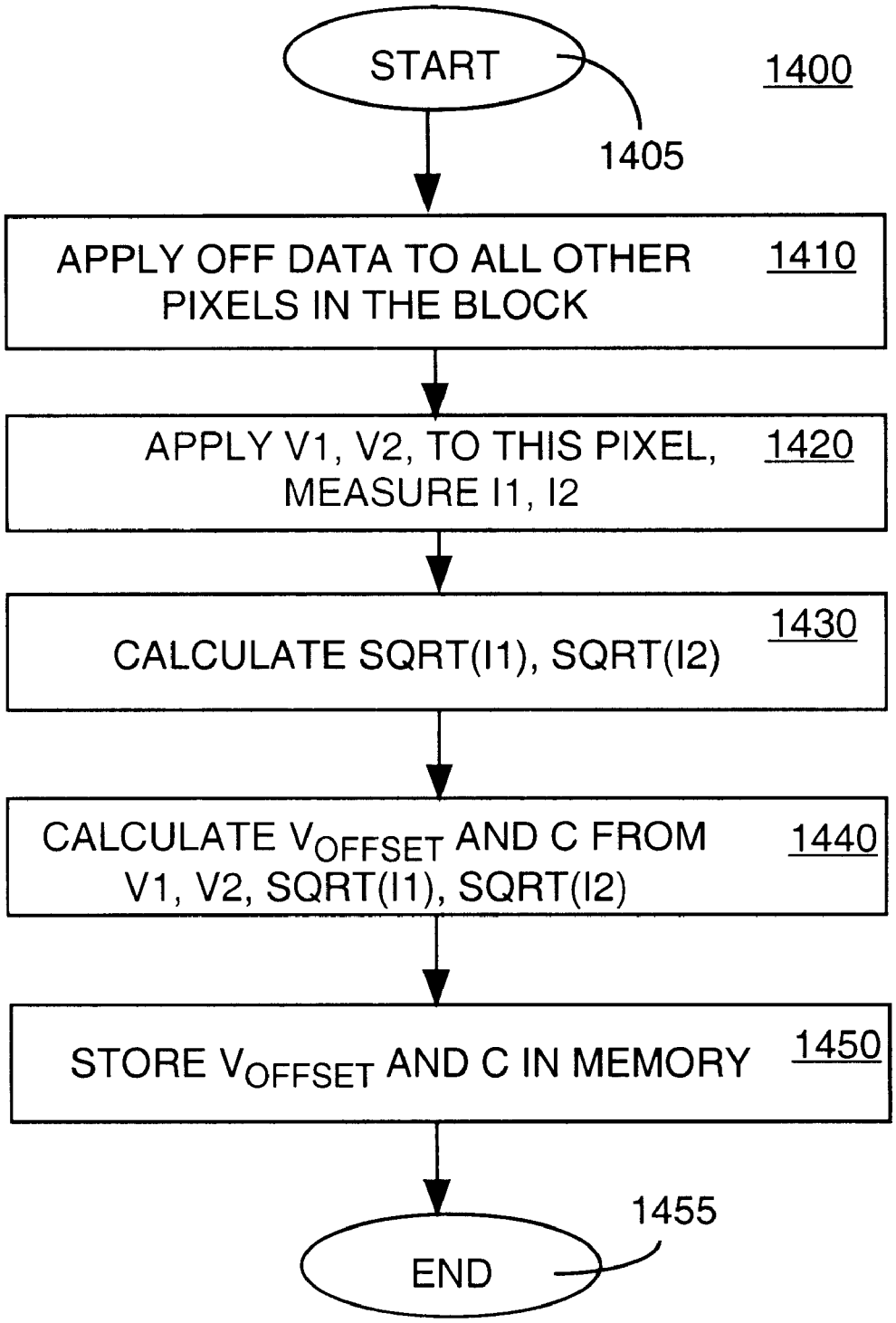
FIG. 14 illustrates a flowchart of a method for initializing the display by measuring the parameters of all the pixels.

FIG. 14 illustrates a flowchart of a method 1400 for initializing the display by measuring the parameters of all the pixels. Method 1400 starts in step 1405 and proceeds to step 1410, where an "off" data voltage is applied to all pixels in a pixel block, except for the pixel of interest.

In step 1420, to determine $V_{offset}$ and C for a given pixel of interest, method 1400 applies two data voltages (V1 and V2), and the current is measured for each data voltage.

In step 1430, the square root of the currents I1 and I2 are calculated. In one implementation, a square root table is used in this calculation.

In step 1440, $V_{offset}$ and C are determined, i.e., two equations are available to solve two variables. In turn, the calculated $V_{offset}$ and C for a given pixel of interest, are stored in a storage, e.g., memory. After all pixels have been measured, the memory contains the two parameters $V_{offset}$ and C for each pixel in the array. These values can be used at a later time to calibrate or adjust $V_{data}$ in accordance with equation (10). Method 1400 then ends in step 1455.

It should be noted that the current through the measured pixel should be high enough such that $$D\sqrt[m]{I}$$

can be treated as approximately the same at the two measurement points. Preferably, this condition can be satisfied by making one measurement at the highest data voltage that the system can generate, and then the other measurement at a slightly lower data voltage.

Once display initialization has been performed, the raw input video data supplied to the display module can be corrected. It should be noted that the input video data can exist in various formats, e.g., the video data can represent (1) pixel voltages, (2) gamma-corrected pixel luminances, or (3) pixel currents. As such, the use of the stored parameters $V_{offset}$ and C to calibrate or adjust the input video data depends on each specific format.

Figure 15:
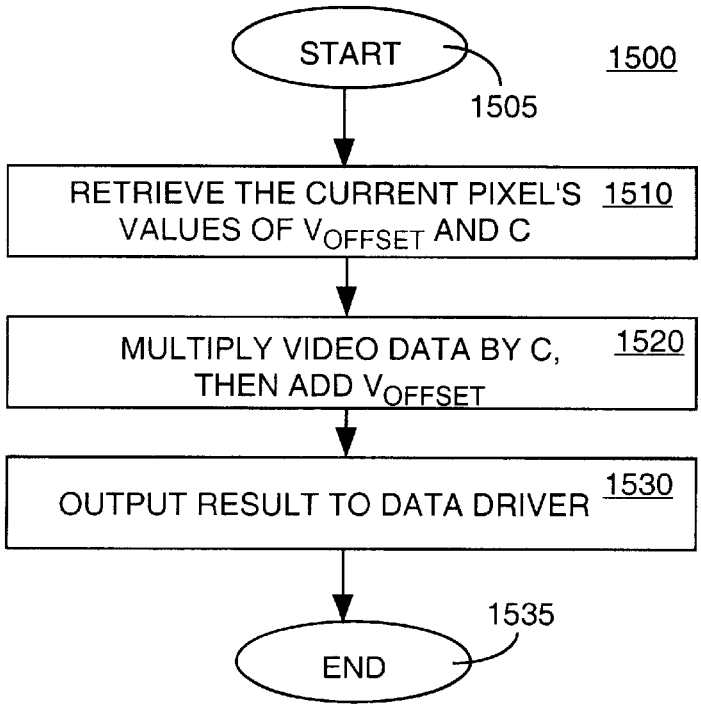
FIG. 15 illustrates a flowchart of a method for correcting input data representing pixel voltages.

FIG. 15 illustrates a flowchart of a method 1500 for correcting input video data representing pixel voltages. Method 1500 starts in step 1505 and proceeds to step 1510, where the stored parameters, e.g., $V_{offset}$ and C are retrieved for a pixel of interest.

In step 1520, method 1500 applies the retrieved parameters to calibrate the input video data. More specifically, it is expected that the input video data are unbiased, i.e., zero volts represents zero luminance, and data greater than zero represent luminance levels greater than zero. Therefore, the voltages can be regarded as equal to $C_0\sqrt{I}$, where I is the desired current and $C_0$ is a constant, e.g., with a typical value $10^3 V/\sqrt{A}$. To compensate for pixel variations, as input video data enters the display module, the value of $V_{data}=V_{offset}+C\sqrt{I}$ is calculated for each pixel, based on the stored values of $V_{offset}$ and C. This calculation consists of multiplying the video data by $C/C_0$, and adding $V_{offset}$ to the result.

The division by $C_0$ can be avoided if the video data $V_{data}$ has already been scaled by the constant factor $1/C_0$. The multiplication by C can be performed directly in digital logic, or using at look-up table. For example, in the latter case, each value of C specifies a table where the value of the video data is an index, and the table entries consist of the result of the multiplication. (Alternatively, the roles of C and the input video data in the look-up table can be reversed.) After the multiplication is performed, rapid addition of $V_{offset}$ can be implemented with digital logic.

In step 1530, the resulting voltage $V_{data}$, i.e., the corrected or adjusted input data, is then forwarded to the data driver of pixel array. Method 1500 then ends in step 1535.

In the case of gamma-corrected luminance data, the input video data are proportional to $L^{0.45}$, where L is luminance. This is typical for video data that have been pre-corrected for CRT luminance-voltage characteristics. Since $L^{0.45}\approx\sqrt{L}$, and the OLED luminance is proportional to its current, the data can be treated as proportional to $\sqrt{I}$. Thus, the calculation can be performed in the same way as for zero-offset voltage data as discussed above.

Figure 16:
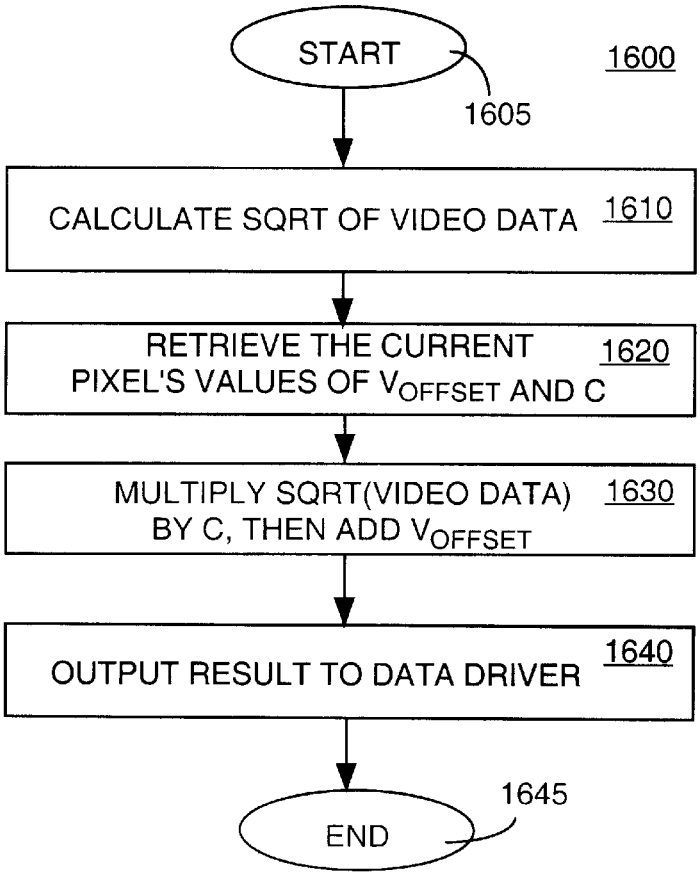
FIG. 16 illustrates a flowchart of a method for correcting input video data representing pixel currents, i.e., luminances.

FIG. 16 illustrates a flowchart of a method 1600 for correcting input video data representing pixel currents, i.e., luminances. Method 1600 starts in step 1605 and proceeds to step 1610, where the square-root values of the measured current are calculated. Namely, method 1600 is similar to the method 1500 described above, with the exception that the video data representing I must be processed to yield $\sqrt{I}$. As noted above, this operation can be implemented using a table that provides square-root values as needed for deriving the pixel parameters $V_{offset}$ and C from pixel current measurements, as illustrated in FIG. 14. Here, this table is used again to generate $\sqrt{I}$ from the video data.

Then, the data correction steps 1610–1645 of method 1600 are identical to the method 1500 as described above, with the exception that the square root of the input data is multiplied by C in step 1630 and then followed by an addition of $V_{offset}$ to yield the corrected data voltage.

Alternatively, in another embodiment, pixel nonuniformity is characterized using only one parameter instead of two or four parameters as discussed above. Namely, an additional simplification is made such that pixel nonuniformity is characterized using a single parameter.

More specifically, in many cases the pixel-to-pixel variation in the gain factor C is small, leaving $V_{offset}$ as the only significant source of nonuniformity. This occurs when the TFT transconductance parameter k and the voltage gain factor B are uniform. In this case, it is sufficient to determine each pixel's $V_{offset}$. Then, data correction does not involve multiplication (since the gain factor C is assumed to be uniform), but only involves addition of the offset parameter.

This one-parameter approximation is similar to the above autozeroing OLED pixel structures. The present one-parameter compensation method should produce satisfactory display uniformity, while reducing computational expense. However, if maintaining display uniformity is very important to a particular display application, then the above described two or four-parameter methods can be employed at the expense of increasing computational complexity and expense.

Again, for one-parameter extraction and data correction, the display initialization process depends on the format of the data. The single-parameter method can be used to initialize the display and to correct video data for the cases of video data representing (1) pixel voltages, (2) pixel currents, and (3) gamma-corrected pixel luminances.

Figure 17:
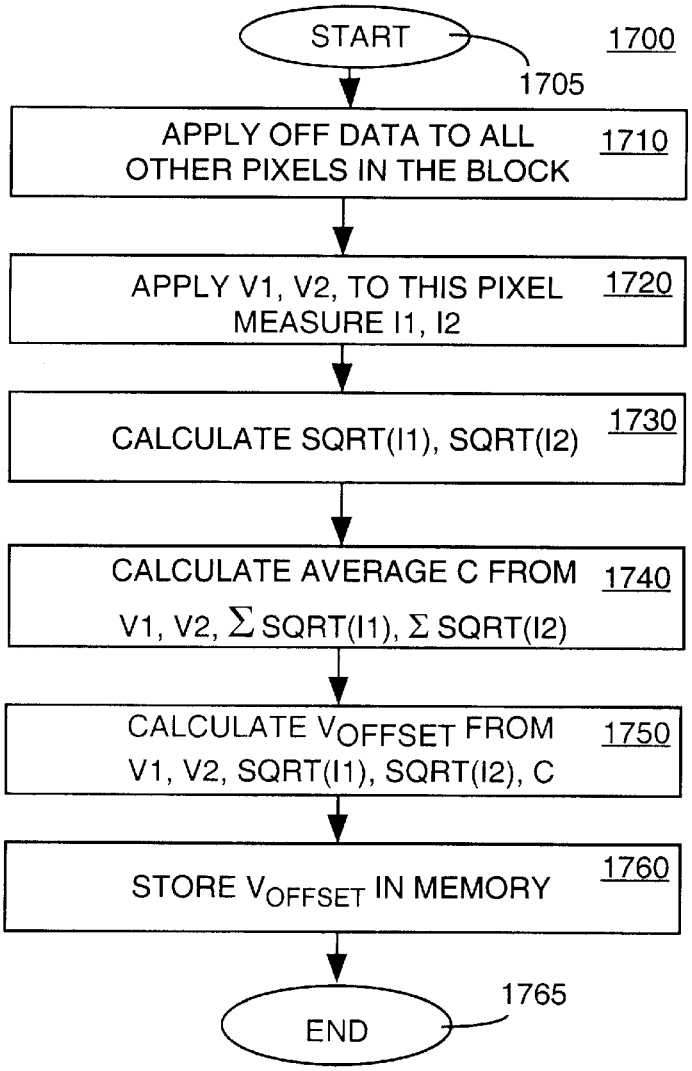
FIG. 17 illustrates a flowchart of a method for initializing the display by measuring the parameters of all the pixels where the video data represent pixel voltage.

FIG. 17 illustrates a flowchart of a method 1700 for initializing the display by measuring the parameters of all the pixels. Method 1700 starts in step 1705 and proceeds to step 1710, where an "off" data voltage is applied to all pixels in a pixel block, except for the pixel of interest.

In step 1720, to determine $V_{offset}$ and C for a given pixel of interest, method 1700 applies two data voltages (V1 and V2), and the current is measured for each data voltage.

In step 1730, the square root of the currents I1 and I2 are calculated. In one implementation, a square root table is used in this calculation.

It should be noted that since the value of C is supposed to be uniform, then ideally it can be determined by making a two-point measurement on a single pixel anywhere in the display. However, this is questionable, since the pixel of interest may be unusual. Thus, a two-point measurement is made on every pixel.

In step 1740, the average C is determined. Namely, using a table to calculate $\sqrt{I}$ for each current measurement, an average value of C for the display can be calculated.

In step 1750, $V_{offset}$ is determined for each pixel from its current measurements based on the average C. In this manner, small variations in C across the display are partially compensated by the calculated $V_{offset}$. For reasons given above, it is preferable to make each pixel's current measurement at the highest possible data voltage.

Finally, in step 1760, each pixel's $V_{offset}$ is stored in a storage, e.g., memory. Method 1700 then ends in step 1765.

Figure 18:
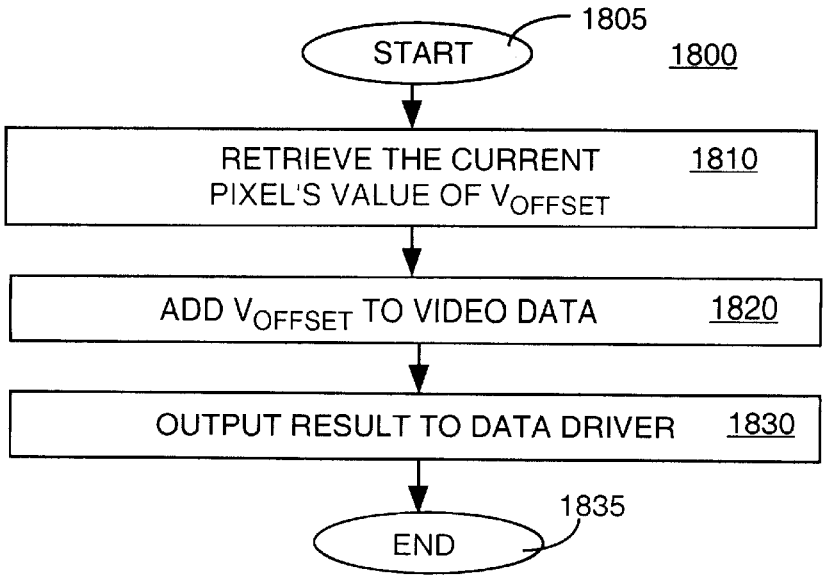
FIG. 18 illustrates a flowchart of a method for correcting input video data representing pixel voltages.

FIG. 18 illustrates a flowchart of a method 1800 for correcting input video data representing pixel voltages. Method 1800 starts in step 1805 and proceeds to step 1810, where the stored parameters, e.g., $V_{offset}$ is retrieved for a pixel of interest.

In step 1820, method 1800 applies the retrieved parameter $V_{offset}$ to calibrate the input video data. More specifically, the value of $V_{data}=V_{offset}+V_{data}$ is calculated for each pixel, based on the stored value of $V_{offset}$.

In step 1830, the resulting voltage $V_{data}$, i.e., the corrected or adjusted input data, is then forwarded to the data driver of pixel array. Method 1800 then ends in step 1835.

Figure 19:
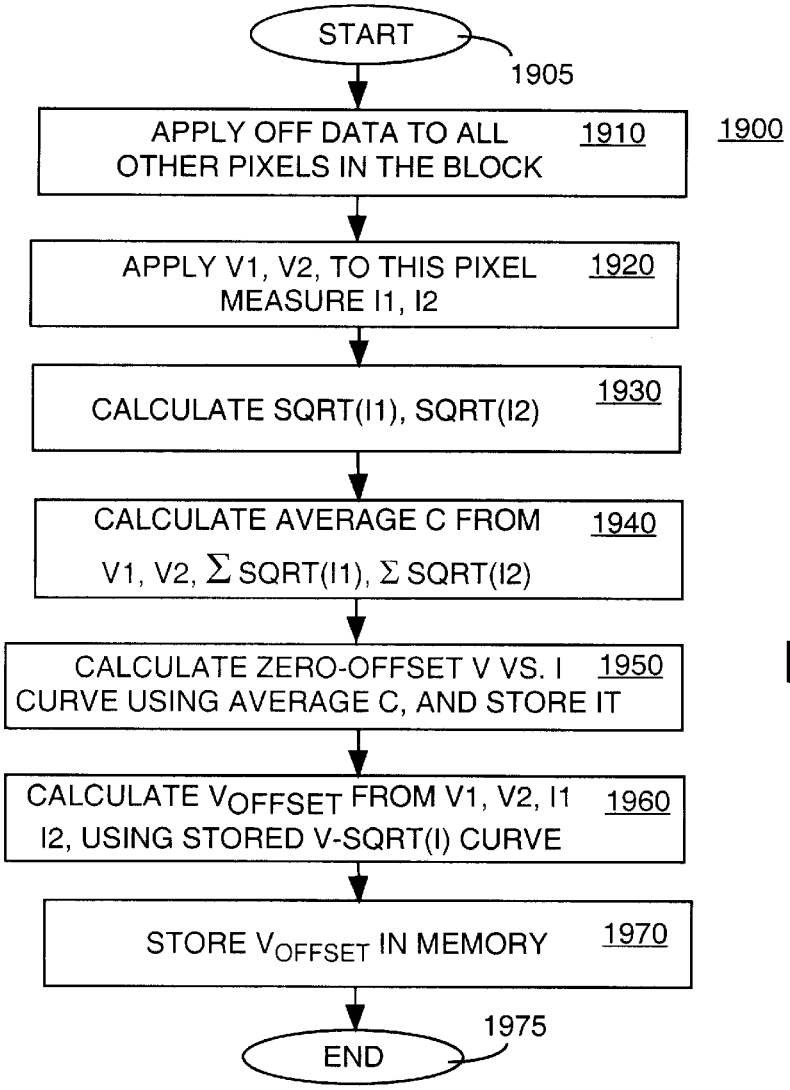
FIG. 19 illustrates a flowchart of a method for initializing the display by measuring the parameters of all the pixels for the situation where the video data represents pixel currents.

FIG. 19 illustrates a flowchart of a method 1900 for initializing the display by measuring the parameters of all the pixels for the situation where the video data represents pixel currents. It should be noted that method 1900 is very similar to method 1700 as discussed above. The exception arises when method 1900 incorporates an additional step 1950, where a calculated average value of C is used to generate a table of zero-offset data voltage vs. pixel current. From this point forward in the initialization and data correction processes, square root operations can be avoided by using this table. The table is expected to provide a more accurate representation of the pixel's current-voltage characteristics than the square-root function. The table is then stored in a storage, e.g., a memory for later use. Then the individual pixel current measurements are used as indexes to enter this table, and individual pixel offsets $V_{offset}$ are determined.

Figure 20:
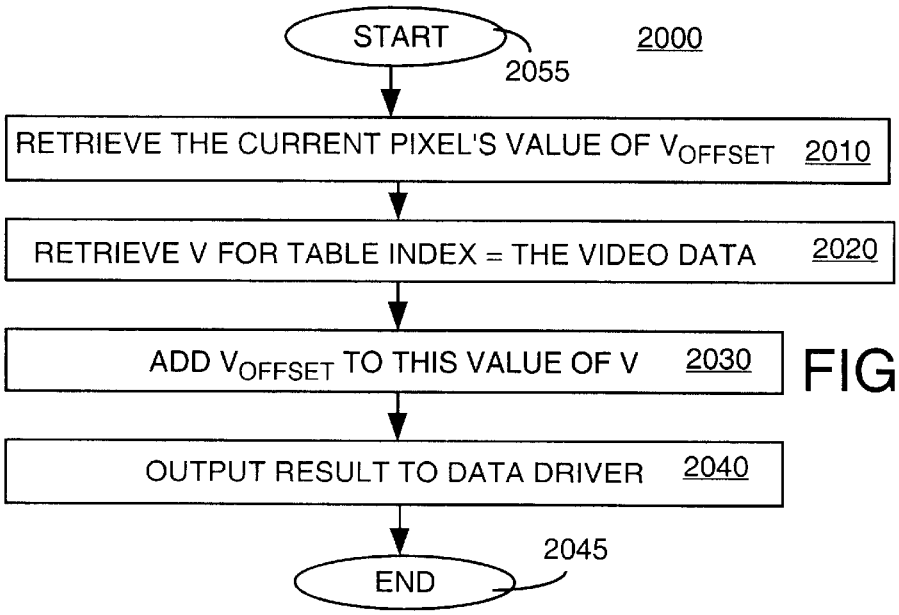
FIG. 20 illustrates a flowchart of a method for correcting input video data represented in pixel currents, i.e., luminances.

FIG. 20 illustrates a flowchart of a method 2000 for correcting input video data represented in pixel currents, i.e., luminances. Method 2000 starts in step 2005 and proceeds to step 2010, where the current pixel of interest's $V_{offset}$ is retrieved from storage.

In step 2020, the zero-offset data voltage vs. pixel current table is used to obtain a zero-offset data voltage from the input video data current. This zero-offset data voltage is added to the retrieved $V_{offset}$ in step 2030. Finally, in step 2040, the corrected or adjusted input video data, is then forwarded to the data driver of the pixel array.

In sum, as video data are introduced into the display module, the zero-offset data voltage corresponding to each current is looked up in the V-I table. Then the stored pixel offset is added to the zero-offset voltage, and the result is the input to the data driver. Method 2000 then ends in step 2045.

Figures 21, 22:
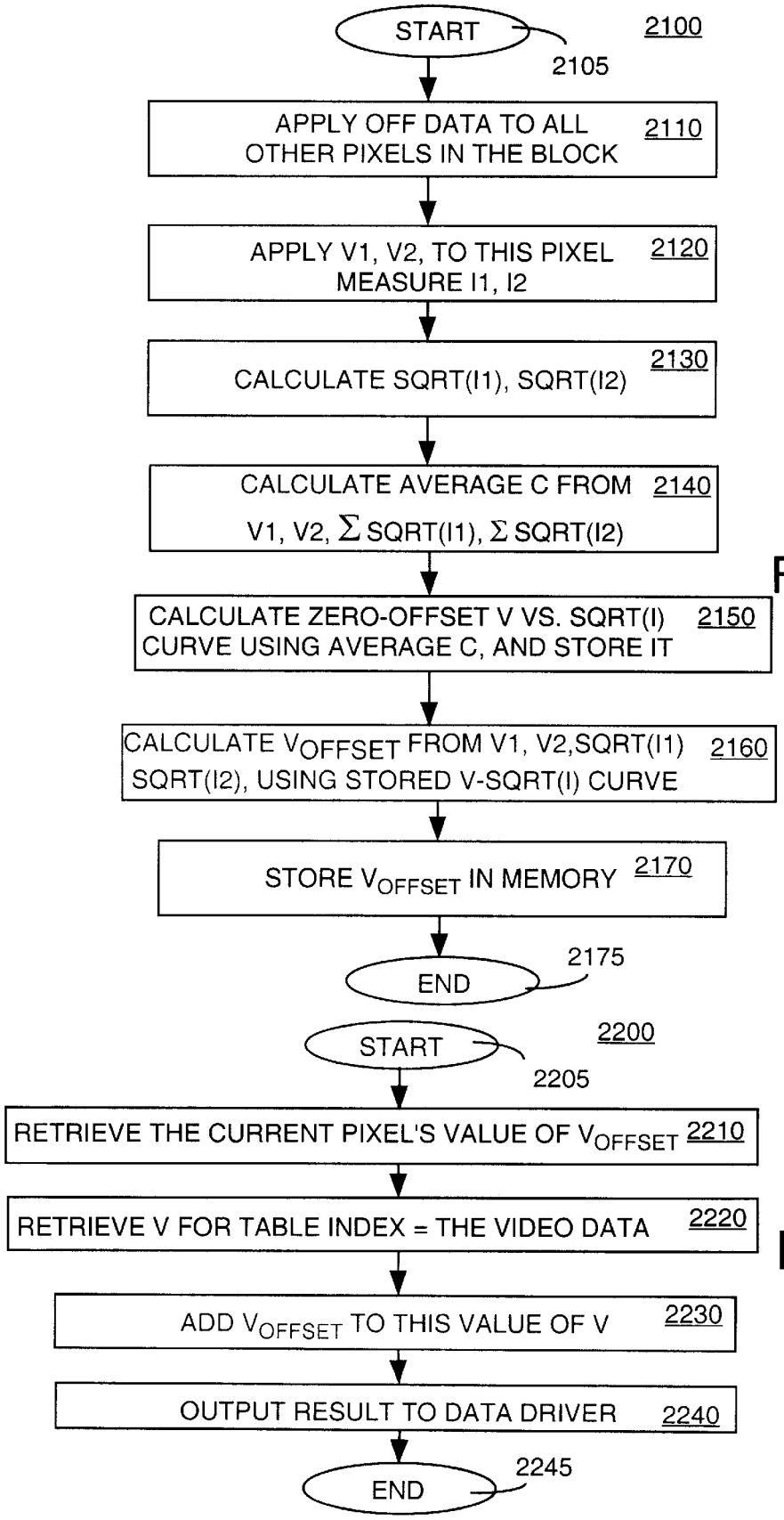
FIG. 21 illustrates a flowchart of a method for initializing the display by measuring the parameters of all the pixels for the situation where the video data represents gamma-corrected luminance data.
FIG. 22 illustrates a flowchart of a method for correcting input video data represented in gamma-corrected luminance data.

FIG. 21 illustrates a flowchart of a method 2100 for initializing the display by measuring the parameters of all the pixels for the situation where the video data represents gamma-corrected luminance data. It should be noted that method 2100 is very similar to method 1900 as discussed above. The exception arises in step 2150 of method 2100, where a calculated average value of C is used to generate a table of zero-offset data voltage vs. the square root of the pixel current. Namely, the video data can be approximated as representing $\sqrt{I}$. As such, the average value of C is used to create a zero-offset table of $V_{data}$ vs. $\sqrt{I}$, and this table is saved in a storage such as a memory.

FIG. 22 illustrates a flowchart of a method 2200 for correcting input video data represented in gamma-corrected luminance data. It should be noted that method 2200 is very similar to method 2000 as discussed above. The only exception arises in the zero-offset table of $V_{data}$ vs. $\sqrt{I}$. Thus, in sum, incoming video data are used to look up the zero-offset data voltages, and stored pixel offsets are added to these voltages.

It should be noted that the above description assumes that the OLED drive transistor N2 is operated in saturation. Similar compensation methods can be used, if N2 is operated in the linear region. In that case, the pixel's current voltage characteristic is expressed as:

$$V_{data} = V_{off} + C(I)I + D\sqrt[m]{I} \tag{11}$$

where C(I) is a weak function of I. Again, the $$D\sqrt[m]{I}$$

term can be incorporated in $V_{off}$, if the current is sufficiently high, such that only an offset term and a gain factor need to be determined as discussed above.

However, the one-parameter approximation, where only the offset voltage is regarded as nonuniform, is not anticipated to be as accurate as the above one-parameter approximation for the saturation case, because now the gain factor C(I) contains the nonuniform OLED parameters A and m. Thus, the two-parameter correction method will likely perform significantly better than the one-parameter correction method, if N2 is operated in the linear region.

Figure 23:
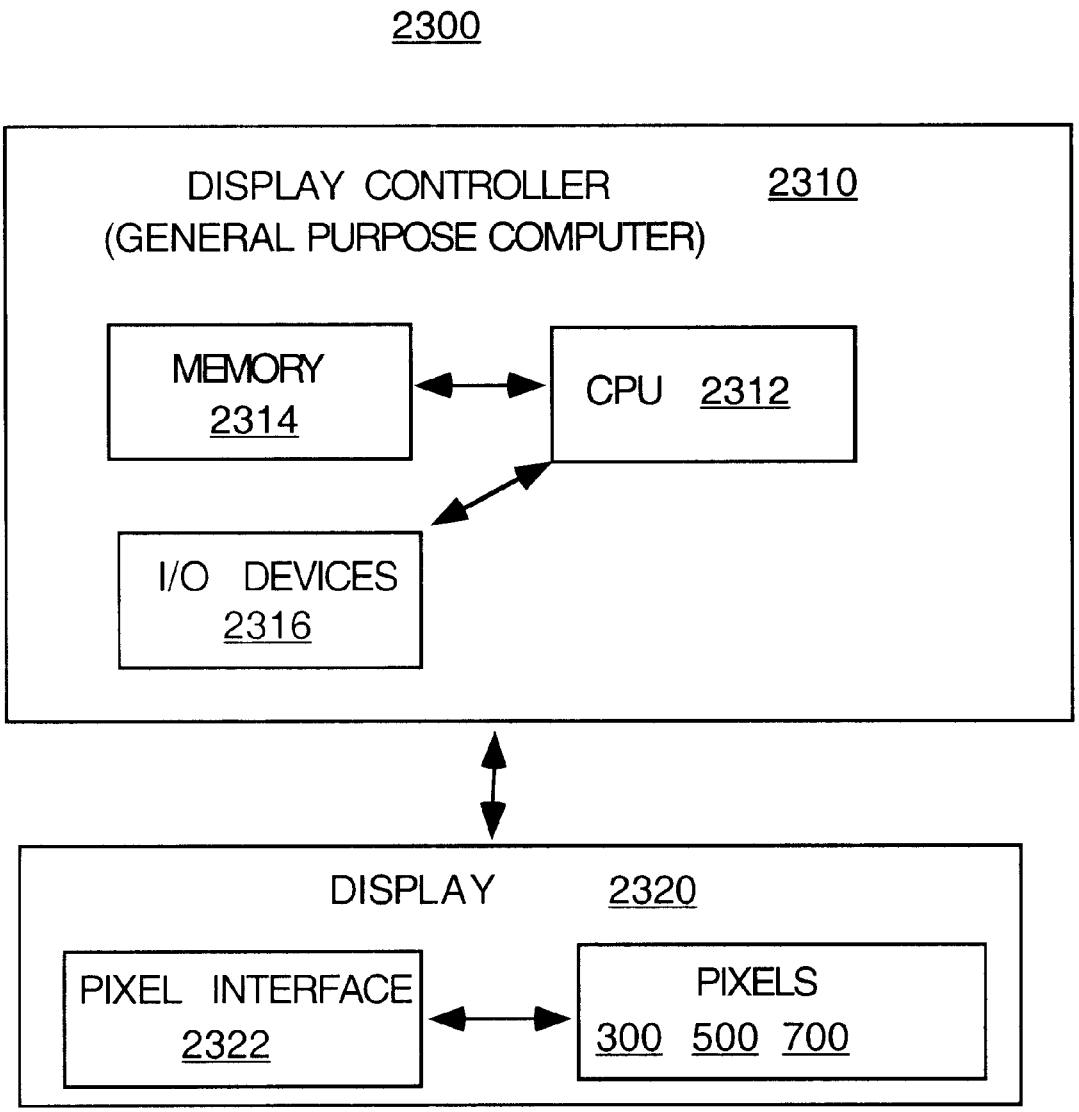
FIG. 23 depicts a block diagram of a system employing a display having a plurality of active matrix LED pixel structures of the present invention.

FIG. 23 illustrates a block diagram of a system 2300 employing a display 2320 having a plurality of active matrix LED pixel structures 300, 500, or 700 of the present invention. The system 2300 comprises a display controller 2310 and a display 2320.

More specifically, the display controller can be implemented as a general purpose computer having a central processing unit CPU 2312, a memory 2314 and a plurality of I/O devices 2316 (e.g., a mouse, a keyboard, storage devices, e.g., magnetic and optical drives, a modem, AID converter, various modules, e.g., measurement module 1330 as discussed above, and the like). Software instructions (e.g., the various methods described above) for activating the display 2320 can be loaded, e.g., from a storage medium, into the memory 2314 and executed by the CPU 2312. As such, the software instructions of the present invention can be stored on a computer-readable medium.

Figure 1:
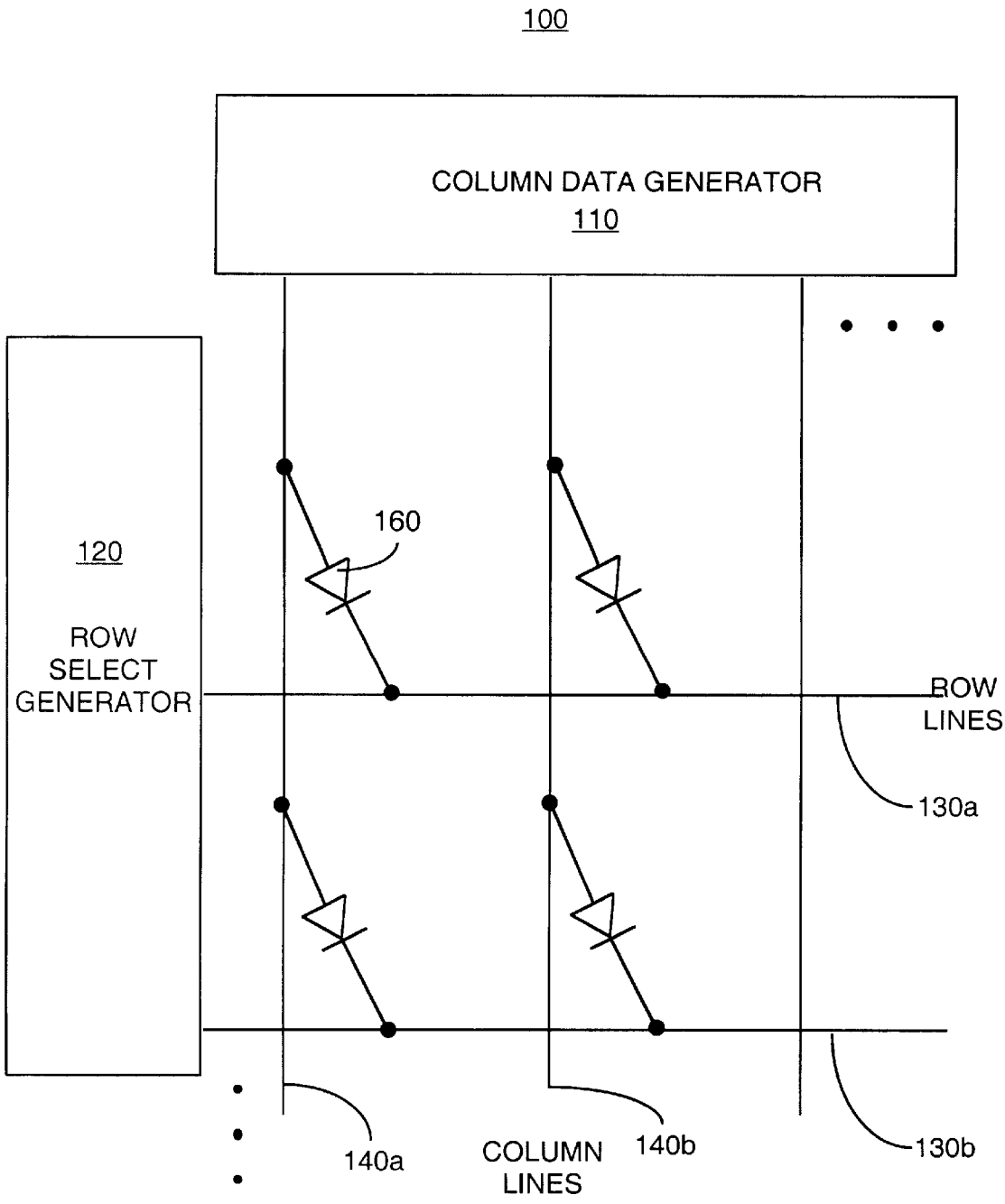
(PRIOR ART) FIG. 1
FIG. 1 depicts a block diagram of a matrix addressing interface.

The display 2320 comprises a pixel interface 2322 and a plurality of pixels (pixel structures 300, 500, or 700). The pixel interface 2322 contains the necessary circuitry to drive the pixels 300, 500, or 700. For example, the pixel interface 2322 can be a matrix addressing interface as illustrated in FIG. 1 and may optionally include additional signal/control lines as discussed above.

Thus, the system 2300 can be implemented as a laptop computer. Alternatively, the display controller 2310 can be implemented in other manners such as a microcontroller or application specific integrated circuit (ASIC) or a combination of hardware and software instructions. In sum, the system 2300 can be implemented within a larger system that incorporates a display of the present invention.

Although the present invention is described using NMOS transistors, it should be understood that the present invention can be implemented using PMOS transistors, where the relevant voltages are reversed.

Although various embodiments which incorporate the teachings of the present invention have been shown and described in detail herein, those skilled in the art can readily devise many other varied embodiments that still incorporate these teachings.

What is claimed is:

1. A display comprising at least one pixel, said pixel comprising:

a first transistor having a gate, a source and a drain, where said gate is for coupling to a first select line;

a capacitor having a first and second terminals, where said drain of said first transistor is coupled to said first terminal of said capacitor;

a second transistor having a gate, a source and a drain, where said drain of said first transistor is coupled to said drain of said second transistor, where said gate of said second transistor is for coupling to an autozero line;

a third transistor having a gate, a source and a drain, where said source of said third transistor is coupled to said drain of said second transistor, where said gate of said third transistor is for coupling to a second select line;

a fourth transistor having a gate, a source and a drain, where said drain of said fourth transistor is coupled to said source of said second transistor, where said gate of said fourth transistor is coupled to said source of said first transistor;

a fifth transistor having a gate, a source and a drain, where said drain of said fifth transistor is coupled to said drain of said third transistor, where said gate of said fifth transistor is coupled to said source of said first transistor; and a light element having two terminals, where said source of said fourth transistor and said source of said fifth transistor are coupled to one of said terminal of said light element.

2. The display of claim 1, wherein said light element is an organic light emitting diode (OLED).

3. The display of claim 1, wherein said transistors are thin film transistors constructed from amorphous-silicon.

4. The display of claim 1, wherein said second select line is an autozero line from a previous row.

5. A display comprising at least one pixel, said pixel comprising:

a first transistor having a gate, a source and a drain, where said gate is for coupling to a first select line;

a capacitor having a first and second terminals, where said drain of said first transistor is coupled to said first terminal of said capacitor;

a second transistor having a gate, a source and a drain, where said source of said first transistor is coupled to said source of said second transistor, where said gate of said second transistor is for coupling to an autozero line;

a third transistor having a gate, a source and a drain, where said source of said third transistor is coupled to said drain of said second transistor, where said gate of said third transistor is for coupling to a second select line;

a fourth transistor having a gate, a source and a drain, where said drain of said fourth transistor is coupled to said source of said third transistor, where said gate of said fourth transistor is coupled to said source of said first transistor;

a fifth transistor having a gate, a source and a drain, where said drain of said fifth transistor is coupled to said drain of said third transistor, where said gate of said fifth transistor is coupled to said source of said first transistor; and a light element having two terminals, where said source of said fourth transistor and said source of said fifth transistor are coupled to one of said terminal of said light element.

6. The display of claim 5, wherein said light element is an organic light emitting diode (OLED).

7. The display of claim 5, wherein said second select line is an autozero line from a previous row.

8. A system comprising:

a display controller; and a display, coupled to said display controller, where said display comprises a plurality of pixels, where each pixel comprises:

a first transistor having a gate, a source and a drain, where said gate is for coupling to a first select line;

a capacitor having a first and second terminals, where said drain of said first transistor is coupled to said first terminal of said capacitor;

a second transistor having a gate, a source and a drain, where said source of said first transistor is coupled to said source of said second transistor, where said gate of said second transistor is for coupling to an autozero line;

a third transistor having a gate, a source and a drain, where said source of said third transistor is coupled to said drain of said second transistor, where said gate of said third transistor is for coupling to a second select line;

a fourth transistor having a gate, a source and a drain, where said drain of said fourth transistor is coupled to said source of said third transistor, where said gate of said fourth transistor is coupled to said source of said first transistor;

a fifth transistor having a gate, a source and a drain, where said drain of said fifth transistor is coupled to said drain of said third transistor, where said gate of said fifth transistor is coupled to said source of said first transistor; and a light element having two terminals, where said source of said fourth transistor and said source of said fifth transistor are coupled to one of said terminal of said light element.

9. A system comprising:

a display controller; and a display, coupled to said display controller, where said display comprises a plurality of pixels, where each pixel comprises:

a first transistor having a gate, a source and a drain, where said gate is for coupling to a first select line;

a capacitor having a first and second terminals, where said drain of said first transistor is coupled to said first terminal of said capacitor;

a second transistor having a gate, a source and a drain, where said drain of said first transistor is coupled to said drain of said second transistor, where said gate of said second transistor is for coupling to an autozero line;

a third transistor having a gate, a source and a drain, where said source of said third transistor is coupled to said drain of said second transistor, where said gate of said third transistor is for coupling to a second select line;

a fourth transistor having a gate, a source and a drain, where said drain of said fourth transistor is coupled to said source of said second transistor, where said gate of said fourth transistor is coupled to said source of said first transistor;

a fifth transistor having a gate, a source and a drain, where said drain of said fifth transistor is coupled to said drain of said third transistor, where said gate of said fifth transistor is coupled to said source of said first transistor; and a light element having two terminals, where said source of said fourth transistor and said source of said fifth transistor are coupled to one of said terminal of said light element.

* * * * *